US011952791B2

(12) United States Patent
Kopish et al.

(10) Patent No.: US 11,952,791 B2
(45) Date of Patent: Apr. 9, 2024

(54) FREESTANDING ENCLOSED OFFICE WITH WALL SUPPORT STRUCTURE

(71) Applicant: KRUEGER INTERNATIONAL, INC., Green Bay, WI (US)

(72) Inventors: Andrew J. Kopish, Green Bay, WI (US); Timothy J. LaFleur, Appleton, WI (US); Nathan A. Quintal, De Pere, WI (US); Bryan J. Rahn, Green Bay, WI (US)

(73) Assignee: Krueger International, Inc., Green Bay, WI (US)

( * ) Notice: Subject to any disclaimer, the term of this patent is extended or adjusted under 35 U.S.C. 154(b) by 48 days.

(21) Appl. No.: 17/716,039

(22) Filed: Apr. 8, 2022

(65) Prior Publication Data

US 2022/0325545 A1 Oct. 13, 2022

Related U.S. Application Data

(60) Provisional application No. 63/173,548, filed on Apr. 12, 2021.

(51) Int. Cl.
*E04H 1/12* (2006.01)
*E04B 1/58* (2006.01)
(Continued)

(52) U.S. Cl.
CPC ..... *E04H 1/125* (2013.01); *E04B 1/5831* (2013.01); *E04B 1/8404* (2013.01);
(Continued)

(58) Field of Classification Search
CPC ..... E04B 1/5831; E04B 1/8404; E04B 2/761; E04B 2/7433; E04B 2/7818; E04B 7/026;
(Continued)

(56) References Cited

U.S. PATENT DOCUMENTS 4,680,910 A * 7/1987 Perk ..... E04B 9/345 52/506.06
4,910,932 A * 3/1990 Honigman ..... E04B 1/08 52/282.4

(Continued)

FOREIGN PATENT DOCUMENTS

WO 2020148674 A1 7/2020

*Primary Examiner* — Jessie T Fonseca
(74) *Attorney, Agent, or Firm* — Andrus Intellectual Property Law, LLP

(57) ABSTRACT

A system for creating an enclosed room, such as an office, in an open space that has a floor and a ceiling. The system includes a support frame that is self-supported on the floor of the open space. The support frame includes a series of head rails supported by a series of vertical columns resting on the floor. The vertical columns support a series of wall panels and the head rails support a ceiling such that the ceiling is supported by the support frame independent of the wall panels. The ceiling of the enclosed room is created by a series of ceiling panels and at least one air intake panel and at least one air exhaust panel. The air exhaust panel includes an exhaust fan that removes air from within the enclosed room and draws fresh air into the enclosed room. The ceiling can include a plurality of adjustable louvers and lighting.

11 Claims, 18 Drawing Sheets

(51) Int. Cl.

| | |
|---|---|
| ***E04B 1/84*** | (2006.01) |
| ***E04B 2/74*** | (2006.01) |
| ***E04B 2/76*** | (2006.01) |
| ***E04B 7/02*** | (2006.01) |
| ***E04C 3/06*** | (2006.01) |
| ***E04C 3/32*** | (2006.01) |
| ***F24F 7/02*** | (2006.01) |
| *E04B 2/78* | (2006.01) |
| *E04C 3/04* | (2006.01) |

(52) U.S. Cl.
CPC ..... *E04B 2/7433* (2013.01); *E04B 2/761* (2013.01); *E04B 7/026* (2013.01); *E04C 3/06* (2013.01); *E04C 3/32* (2013.01); *F24F 7/025* (2013.01); *E04B 2/7818* (2013.01); *E04C 2003/0465* (2013.01)

(58) Field of Classification Search
CPC . E04B 7/163; E04B 9/006; E04C 3/06; E04C 3/32; E04C 3/40; E04C 2003/0465; E04H 1/125; F24F 7/025; F24F 11/0001
See application file for complete search history.

(56) References Cited

U.S. PATENT DOCUMENTS 5,319,903 A * 6/1994 Holland ..... E04H 1/125 52/79.9
5,467,562 A * 11/1995 Holland ..... E04H 1/125 52/79.9
5,680,737 A * 10/1997 Sheipline ..... F16B 7/0453 403/205
5,813,174 A * 9/1998 Waller ..... E04H 9/06 109/78
6,205,716 B1 3/2001 Peltz
6,247,272 B1 6/2001 Shipman
6,248,014 B1 6/2001 Collier
6,332,295 B1 12/2001 Spielhoff
6,415,557 B1 * 7/2002 McCalley ..... E04H 9/14 52/584.1
6,712,543 B1 * 3/2004 Schmalzhofer ..... F16B 7/187 403/258
7,458,305 B1 * 12/2008 Horlander ..... F41H 5/24 52/800.1
D641,090 S 7/2011 Clark
D732,691 S 6/2015 Hallfors
D732,692 S 6/2015 Hallfors
9,169,640 B2 10/2015 Jeffers et al.
9,506,247 B2 11/2016 Feldpausch et al.
9,518,387 B2 12/2016 Geister et al.
9,642,219 B2 5/2017 Mead et al.
9,841,554 B2 12/2017 Hofman
9,903,114 B2 2/2018 Partridge et al.
10,057,963 B2 8/2018 Mead et al.
10,172,456 B2 1/2019 Gaschy et al.
D844,810 S 4/2019 Hallfors et al.
10,260,227 B2 * 4/2019 Corbett ..... F16B 7/185
D870,316 S 12/2019 Haveri et al.
D872,302 S 1/2020 Tibi et al.
D886,324 S 6/2020 Haveri et al.
D895,148 S * 9/2020 Wallinmaa ..... D25/16
10,900,217 B2 1/2021 Fransen
10,907,370 B1 2/2021 Waskey
10,982,455 B2 * 4/2021 Wang ..... E04B 1/34321
2002/0189170 A1 12/2002 Reuschel et al.
2004/0003545 A1 1/2004 Gillespie
2006/0097608 A1 5/2006 Dugand
2007/0190919 A1 * 8/2007 Donovan ..... F24F 11/0001 454/137
2010/0101155 A1 4/2010 Reid et al.
2012/0028560 A1 * 2/2012 Nikolic ..... F24F 7/013 454/239
2015/0345136 A1 12/2015 Murray et al.
2015/0377414 A1 * 12/2015 Pirseyedi ..... F16B 7/0466 403/205
2017/0295929 A1 10/2017 Gaschy et al.
2018/0202156 A1 7/2018 Partridge et al.
2019/0072288 A1 * 3/2019 Niemiec ..... E04B 9/02
2019/0186765 A1 * 6/2019 Haveri ..... F24F 7/013
2019/0257070 A1 * 8/2019 Grosch ..... E04B 1/5831
2020/0200412 A1 * 6/2020 Singh ..... F24F 7/10
2020/0256047 A1 * 8/2020 Grosch ..... E04B 1/5831
2020/0263887 A1 * 8/2020 Mergener ..... F24F 13/084
2020/0277784 A1 9/2020 Partridge et al.
2020/0354513 A1 * 11/2020 Niemiec ..... F04D 29/703
2020/0359532 A1 * 11/2020 VanGilder ..... G05B 13/041
2021/0062505 A1 * 3/2021 Elmore ..... E04F 10/10
2022/0098852 A1 * 3/2022 Wiedebush ..... E04B 1/34326
2022/0316724 A1 * 10/2022 Matsuzaki ..... F24F 3/167
2022/0341161 A1 * 10/2022 Love ..... E04B 2/7433
2022/0341162 A1 * 10/2022 Patton ..... E04B 2/7818

* cited by examiner

FREESTANDING ENCLOSED OFFICE WITH WALL SUPPORT STRUCTURE

BACKGROUND

The present disclosure generally relates to a freestanding office structure. More specifically, the present disclosure relates to a freestanding office structure that includes a frame that can be used with or without a ceiling and can be used to seismically support walls without attachment to a building ceiling/wall or other structure. The freestanding frame is fastened to the floor of a building to provide support in an open business interior.

Traditionally, walls of an office structure are supported by a building's structure. Thus, during seismic activity, the walls and ceiling of an office structure react to the movement of the building. In other embodiments, the walls of the office structure can be braced to the ceiling of the building. If the ceiling of the building is too high, the bracing between the office structure and the building becomes an issue. The present disclosure is directed to a freestanding office structure that is isolated from the walls and ceiling of a building and includes a self-supporting support frame for both wall panels and a ceiling.

SUMMARY

The present disclosure is directed to a system for creating an enclosed room or office within an open space. More specifically, the present disclosure is directed to a system that allows an enclosed room to be created in an open space without relying on any other structural components in the open space, other than the floor of the open space.

The system of the present disclosure includes a frame structure that has a plurality of vertical columns that each have a first end supported on the floor of the open space. The frame structure further includes a plurality of horizonal head beams that are connected to second ends of the vertical columns to define the self-standing frame structure. The system further includes a plurality of anchor brackets mounted to the floor of the open space. The anchor brackets are sized and positioned to receive the first end of one of the vertical columns. In this manner, the anchor brackets provide mounting locations for each of the vertical columns on the floor of the open space.

The system of the present disclosure further includes a ceiling that is supported by the frame structure. The ceiling can have a wide variety of configurations, each of which is supported only by the frame structure. In addition, the frame structure can support wall panels, glass wall panel and/or a door assembly. Since the frame structure is self-supported on the floor, the wall panels are not required to support the ceiling. In embodiments in which the wall panels are formed from glass, if the glass wall panels would break, the ceiling would remain supported by the frame structure.

In one contemplated embodiment of the present disclosure, the ceiling can include a series of ceiling panels, at least one air exhaust panel and at least one air inlet panel. The air exhaust panel includes an exhaust fan that is operable to withdraw air from the enclosed rooms and to exhaust the withdrawn air into the open space surrounding the enclosed office space. The air exhaust panel can include a first vent open to an interior of the enclosed office space and a second vent open to the open space surrounding the office space. An air plenum is created between the first vent and the second vent to allow the withdrawn air to move between the pair of spaced vents.

In another contemplated embodiment, the air inlet panel is used with the air exhaust panel to allow air to flow into the enclosed interior of the office space. The air inlet panel includes a first vent open to the interior of the enclosed room and a second vent open to the open space surrounding the office. The first and second vents are connected by an air plenum to allow air to flow between the two vent openings. When the exhaust fan of the air exhaust panel is operated, the exhaust fan creates a low pressure within the enclosed office space, which pulls fresh air into the enclosed space through the vents of the air inlet panel.

In another contemplated exemplary embodiment, the ceiling of the enclosed room or office can include a series of movable louvers. The louvers can be used in combination with one or more ceiling panels or the entire ceiling can be formed by the movable louvers.

Various other features, objects and advantages of the invention will be made apparent from the following description taken together with the drawings.

BRIEF DESCRIPTION OF THE DRAWINGS

The drawings illustrate the best mode presently contemplated of carrying out the disclosure. In the drawings.

DETAILED DESCRIPTION

Figure 1:
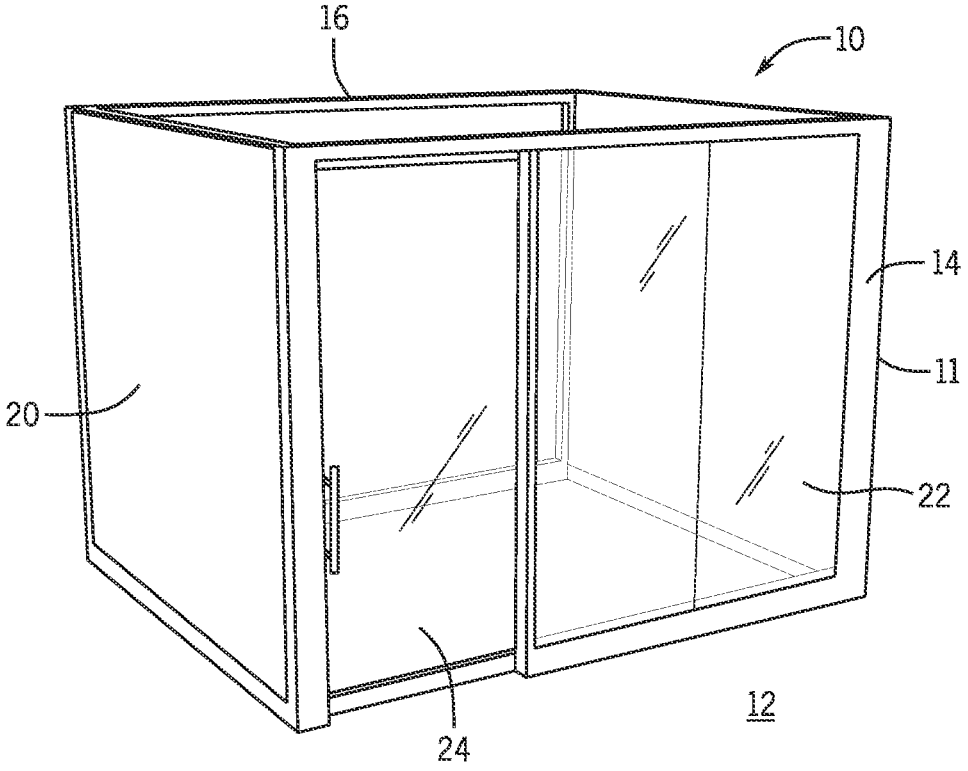
FIG. 1 is an isometric view of a freestanding office structure formed in accordance with one exemplary embodiment of the present disclosure.

FIG. 1 illustrates a freestanding office structure 10 constructed in accordance with the present disclosure. The freestanding office structure 10 is designed to provide an enclosed office space within a larger, open space where the office space can be created without utilizing or requiring support from a building wall or ceiling. The office structure 10 shown in FIG. 1 is supported on a floor 12 but is not supported by any other structure within a building. In the embodiment shown in FIG. 1, the office structure 10 includes a freestanding support frame 11 that is formed from a series of vertical columns 14 that are each joined to each other by a series of horizontal head beams 16. In an exemplary embodiment of the present disclosure, the head beams 16 18 are formed from extruded aluminum beams that can be cut to the desired length either on the assembly site or prior to shipment to the assembly site. In a similar manner, the vertical columns are also formed from an extruded aluminum and can be cut to the desired height either at the assembly site or prior to shipment to the assembly site. The open spaces between the vertical columns 14 can be filled with combinations of solid wall panels 20, glass wall panels 22 and a solid or glass door 24. In the embodiment shown in FIG. 1, the support frame 11 is not shown with an overhead ceiling, although other embodiments will include an overhead ceiling as will be described in greater detail below.

In the embodiment shown in FIG. 1, the vertical columns 14 and head beams 16 are engineered to resist seismic forces and the assembled support frame 11 is designed to support solid or glass wall panels as illustrated. Although solid wall panels 20 are shown, butted glass wall panels can also be supported in the frame openings defined by the support frame 11. The freestanding office structure 10 is designed such that the vertical columns 14 support any overhead ceiling and any of the wall panels. Thus, during any seismic activity, if the glass wall panels fracture or break, the overhead ceiling would be fully supported by the support frame 11. The freestanding office structure 10 shown in FIG. 1 is designed to be used to create multiple banks of offices that are either separate or can be constructed in back-to-back offices that share walls. The system of the present disclosure is designed to be modular in nature and allows multiple sizes of offices to be constructed by adding or removing components from a common kit of parts.

Figure 2:
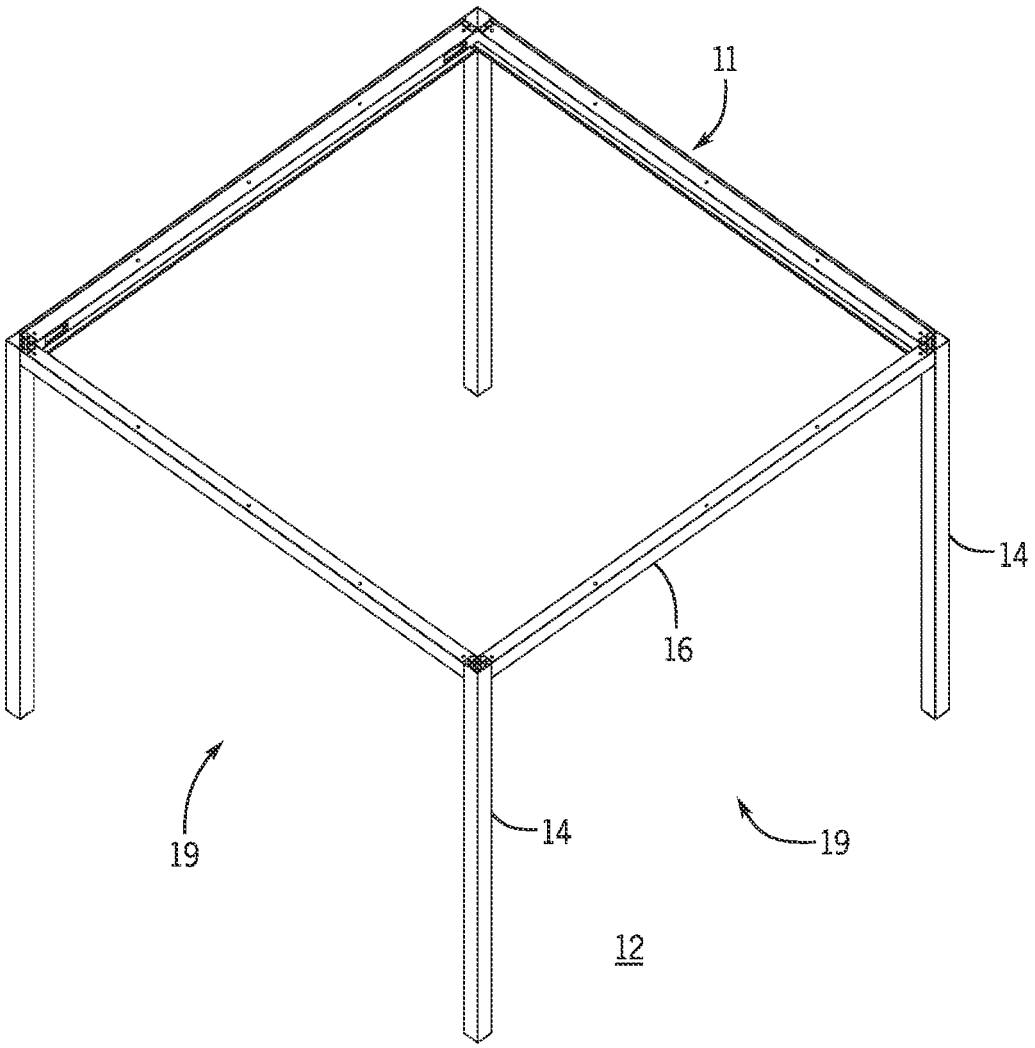
FIG. 2 is an isometric view of the frame structure used in forming the freestanding office of FIG. 1.

Referring now to FIG. 2, thereshown is a detailed view of the support frame 11 of the present disclosure. As described previously, the support frame 11 includes vertical columns 14 positioned at the corners of the support frame 11. The vertical columns 14 are joined to each other by a series of head beams 16. The series of vertical columns 14 create the frame openings 19 that receive the solid wall panels, glass wall panels, doors or similar structures that help create the enclosed interior of the office structure. As described previously, the height of the vertical columns 14 and the length of the head beams 16 can be modified or selected based on the desired size of the enclosed office space. In the embodiment shown in FIG. 2, each of the head beams 16 has the same length such that the office space is square. However, it is contemplated that the front and back head beams could be extended to create a rectangular office space.

Figure 3:
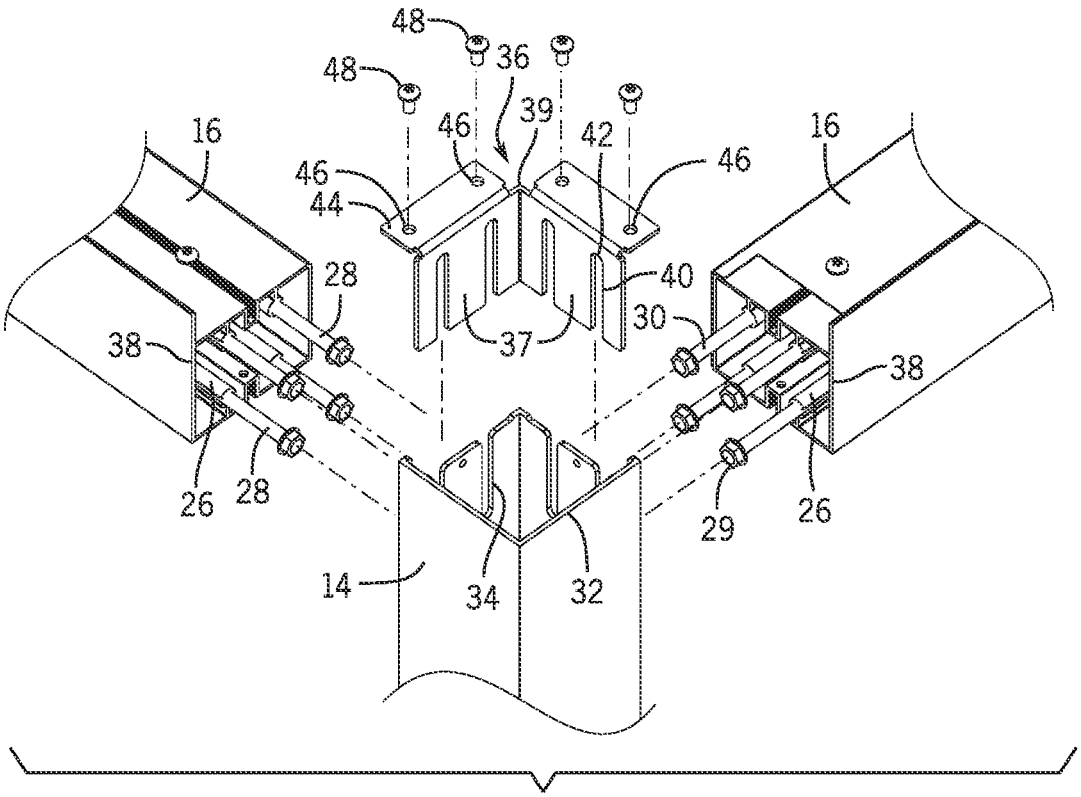
FIG. 3 is a magnified, exploded view showing the interconnection between a pair of head beams and a vertical column that form part of the frame structure.

Referring now to FIG. 3, each of the head beams 16 is formed as an extruded aluminum part that includes a series of receiving channels 26 that extend along the length of the extruded part. The receiving channels 26 are sized such that each can receive a threaded shank portion 30 of a connecting bolt 28. The connecting bolts 28 each include a head 29 that has an expanded diameter relative to the threaded shank portion 30.

As illustrated in FIG. 3, a first, top end 32 of the vertical column 14 includes a pair of attachment slots 34 that each extend into the body of the vertical column 14 from the top end 32. The attachment slots 34 each have a depth that is greater than the vertical spacing between the top and bottom connectors of each of the two pair of connecting bolts 28. In this manner, each of the head beams 16 can move vertically relative to stationary vertical column 14. During assembly, each of the head beams 16 is installed by placing the vertically aligned connecting bolts 28 within the pair of spaced attachment slots 34. Once in the proper position, a header lock bracket 36 is installed between the inner surface of one of the sides of the vertical column 14 and the underside of the bolt head 29. The lock bracket 36 includes a pair of arms 37 that extend at a 90° angle relative to each other and are joined by a corner 39. The single lock bracket 36 is thus used to create the corner between the two head beams 16. Each arm 37 includes a pair of receiving slots 40 that are defined at a top end by a top wall 42. The top wall 42 limits the distance the lock bracket 36 can be moved vertically downward relative to the connecting bolts 28. The lock bracket 36 includes a pair of horizontal top flanges 44 that each include a pair of openings 46 each sized to receive one of a pair of connectors 48. The connectors 48 are designed to be self-tapping screws that go through the top walls of the horizontal beam As can be understood in FIG. 5, the top wall 42 of each of the receiving slots 40 formed in the lock bracket 36 provides the required vertical support of the respective head beam 16 relative to the vertical column 14. As can be understood in FIGS. 2 and 3, each end of each head beam 16 is secured to one of the vertical columns 14 to create the support frame 11 that is self-supporting on the floor surface.

Figure 4:
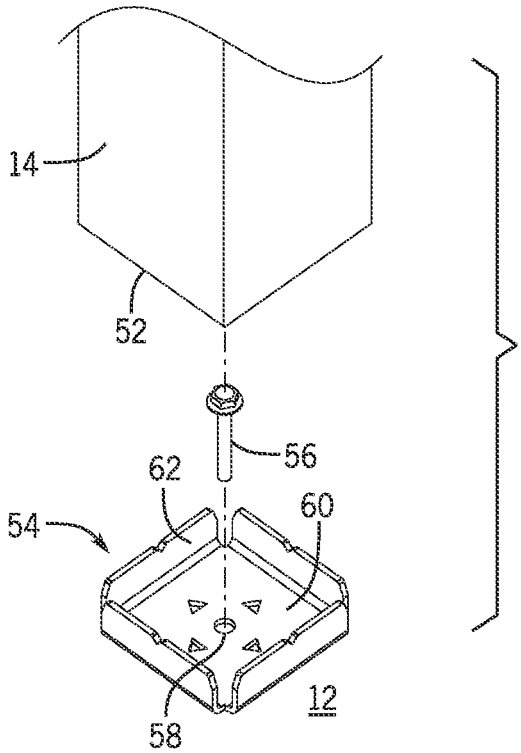
FIG. 4 is an magnified, exploded view showing the connection of the vertical column to a floor anchor bracket.

Referring now to FIG. 4, the vertical column 14 of the support frame includes a second, bottom end 52 that is designed to be supported on the floor 12 of the open space that includes the office structure once assembled. In the embodiment shown in FIG. 4, a floor anchor bracket 54 is securely mounted to the floor 12 by a floor anchor bolt 56. The anchor bolt 56 extends through a center opening 58 in the bottom plate 60. The floor anchor bracket 54 further includes a series of side flanges 62 that extend perpendicular to the bottom plate 60. The side flanges 62 create an outer perimeter of the floor anchor bracket 54 that is designed to be received within the open interior defined by the vertical column 14.

Figure 6:
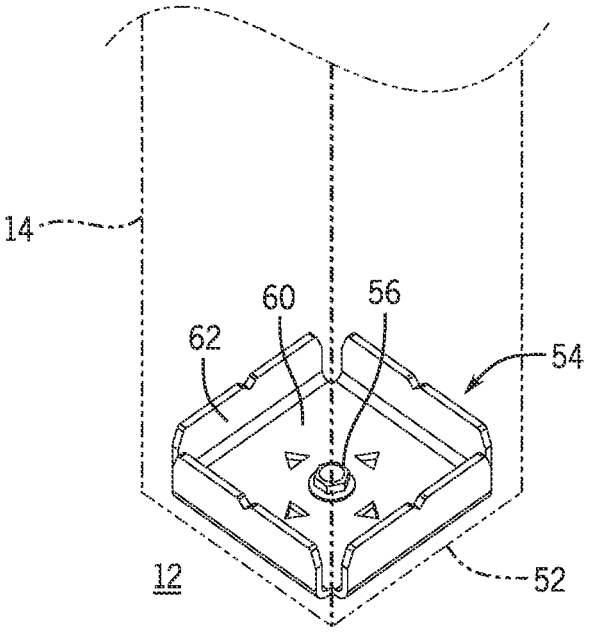
FIG. 6 is a partial view showing the connection of the vertical column to a floor anchor bracket.

Referring now to FIG. 6, when the floor anchor bracket 54 is received within the second end 52 of the vertical column 14, the side flanges 62 provide support to prevent lateral movement of the vertical columns 14 while allowing for vertical movement relative to the stationary floor anchor bracket 54. Such movement allows the series of vertical columns 14 to move vertically relative to the floor 12 during a seismic event while at the same time restricting any lateral movement of the vertical columns 14.

Figure 5:
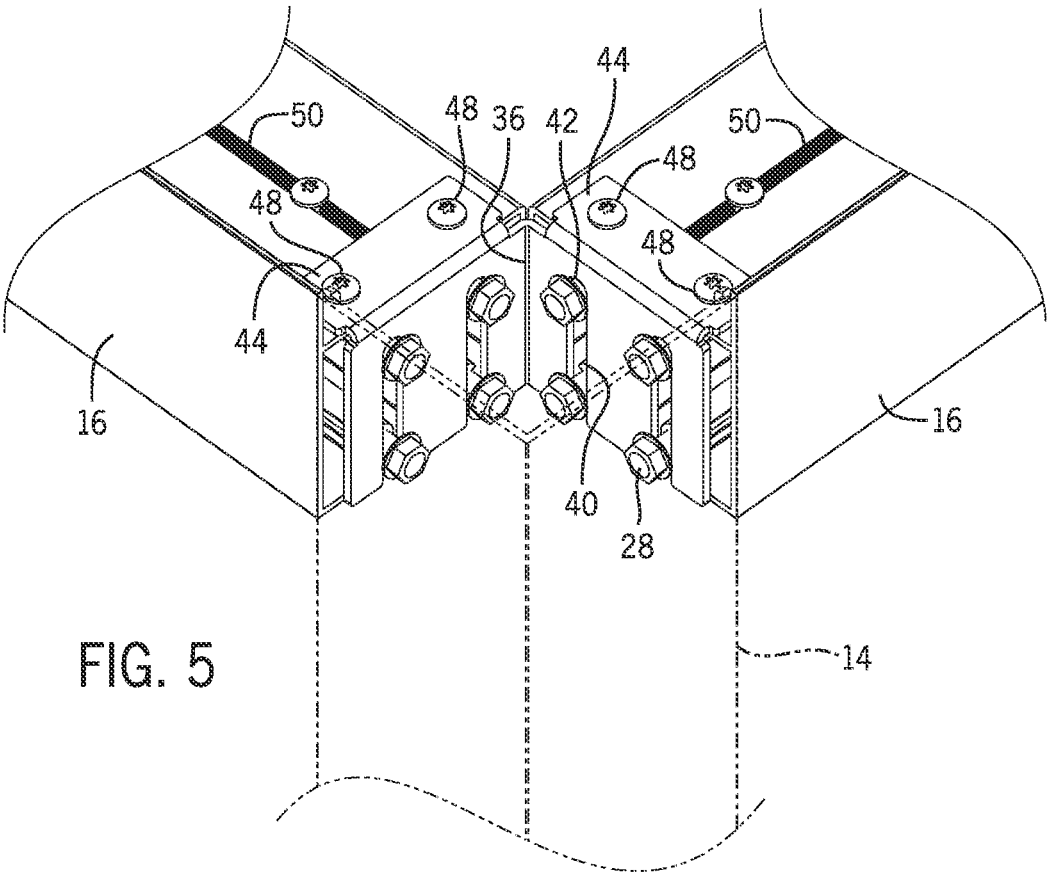
FIG. 5 is a partial view showing the interconnection between a pair of header beams and one of the vertical columns.

As can be understood in the combination of FIGS. 2 and 5-6, the support frame 11 is securely supported on the floor 12 of the open space without requiring any connecting support between the support frame 11 and either the walls of the open space or the ceiling of the open space. In this manner, the support frame 11 can be constructed independent of the support structures of the open space, other than the floor 12.

Figure 7:
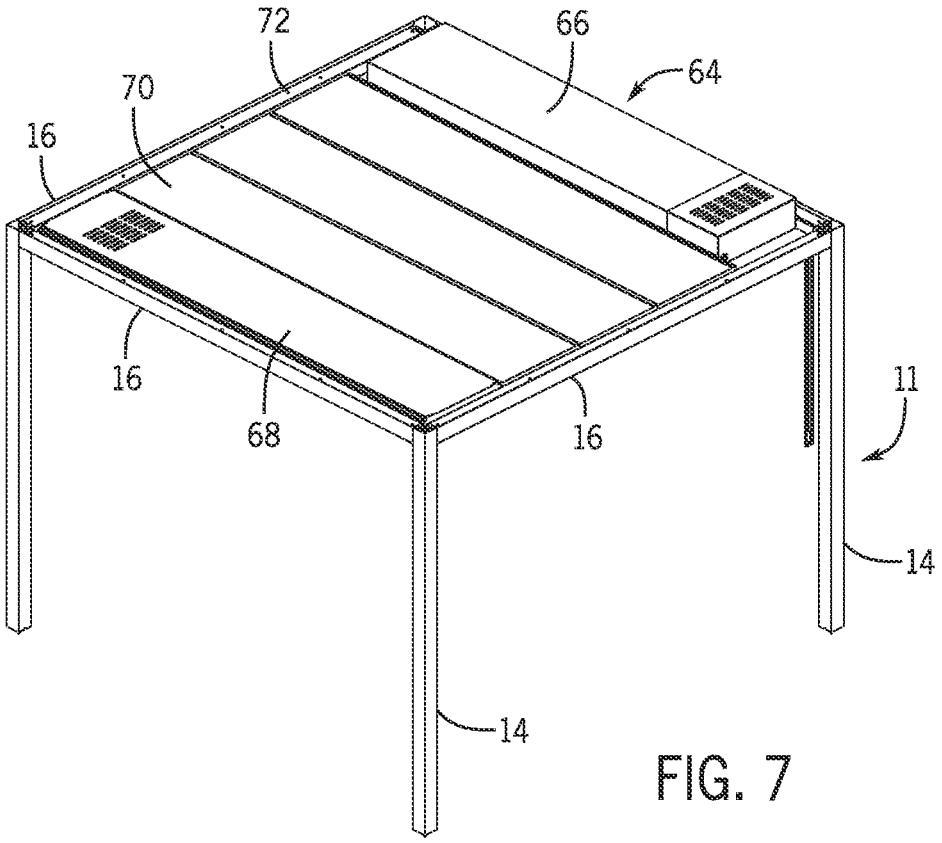
FIG. 7 is a top isometric view showing one exemplary embodiment of a completed ceiling supported by the frame structure.
Figure 8:
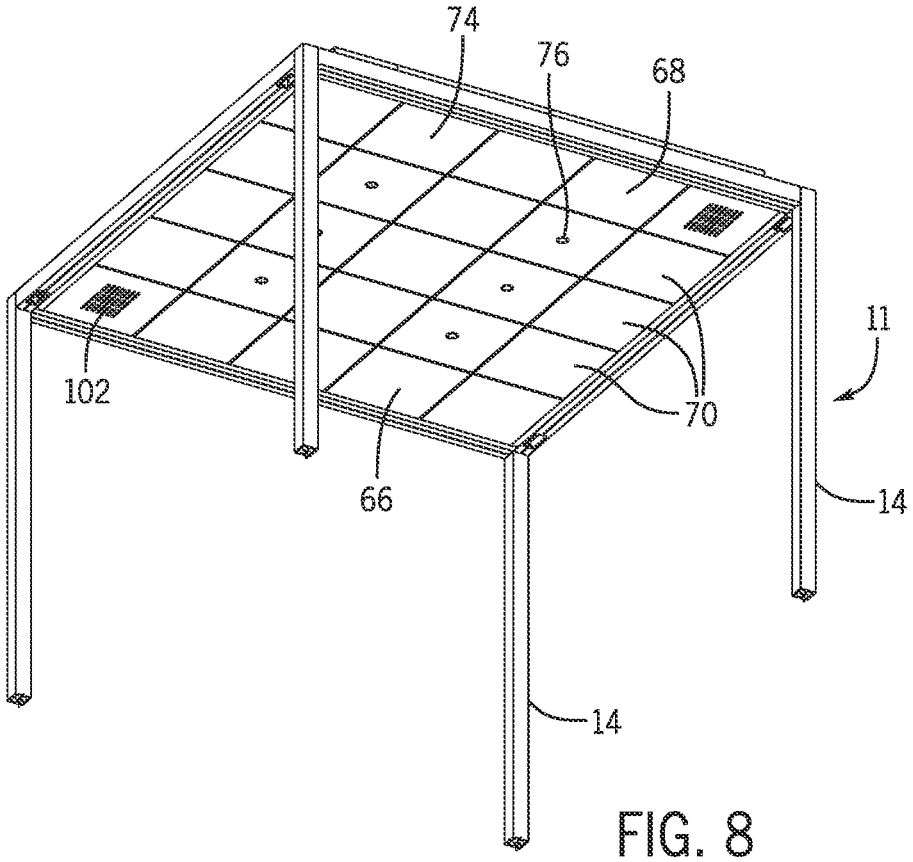
FIG. 8 is a bottom isometric view of the exemplary embodiment of the completed ceiling shown in FIG. 7.

FIGS. 7 and 8 illustrate a first exemplary embodiment of an office structure constructed utilizing the support frame 11. In the embodiment illustrated, the office structure created by the freestanding support frame 11 includes an overhead ceiling 64. The overhead ceiling 64, along with wall panels, creates an entirely enclosed office space. In the exemplary embodiment shown in FIG. 7, the ceiling 64 of the office structure includes an air exhaust panel 66, an air inlet panel 68 and three separate ceiling panels 70. The series of panels that define the ceiling 64 are each supported by a header bracket 72 mounted to the pair of head beams 16 that define the front and back of the office space. The opposite head beams 16 define the sides of the office space and each support either the side edge of the air exhaust panel 66 or the side edge of the air inlet panel 68.

Referring now to the underside view of FIG. 8, each of the panels includes an underside that includes a series of sound absorbing tiles 74 that are attached to the bottom of the respective panel. The tiles 74 each include a center score that defines a circular opening in the center of the tile 74. If the tile 74 is going to include a light, the center score is used to remove center cutout to provide access for a light 76. Before the center cutout is removed, the center score is not visible from beneath. If the tile 74 is going to be used with a light, the center cutout is remove and the tile is attached to the bottom surface of the panel.

The sound absorbing tiles 74 can be made from PET and are designed to absorb sound within the open interior of the office structure. The sound absorbing tiles 74 are attached to the bottom surface of each panel by a series of screws. The combination of the tiles 74 and the lights 76 are used to provide an overall visually appealing appearance and desirable sound dampening when a user is positioned within the office structure. The lights 76 are preferably LED lights that are low power consuming and are connected to a supply of electricity and can be operated utilizing either a wireless switch or through a wired light switch. In the embodiment illustrated, the lights 76 are controlled by a wireless switch as will be described in greater detail below. Although one contemplated embodiment for the ceiling 64 is illustrated that includes three ceiling panels 70, a single air exhaust panel 68 and a single air inlet panel 68, it is contemplated that a ceiling could include different components, could eliminate either or both of the air exhaust panel 68 and the air inlet panel 68, could include greater or fewer numbers of ceiling panels 70 depending upon the size of the office structure and the associated support frame 11.

As can be understood in FIGS. 7 and 8, the ceiling 64 is completely supported by the support frame 11 and is not supported by any of the wall panels that are positioned between the vertical columns 14. Thus, during seismic activity, if any of the wall panels should fracture, shatter, or become dislodged, the ceiling 64 will remain supported entirely by the support frame 11.

Figure 9:
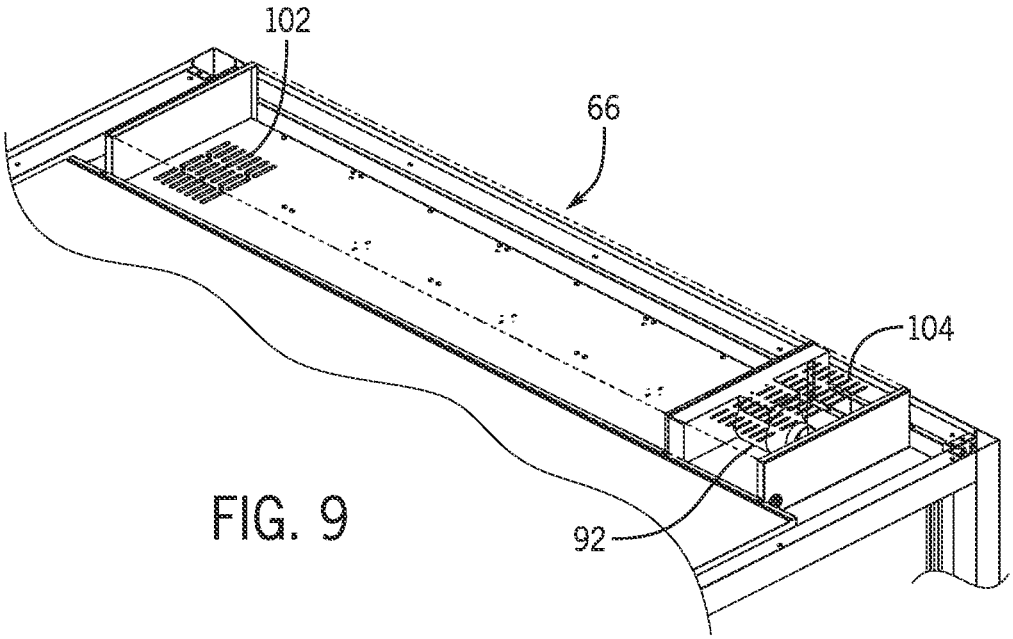
FIG. 9 is a partial section view of an air exhaust panel that forms part of the completed ceiling shown in FIG. 7.
Figure 14:
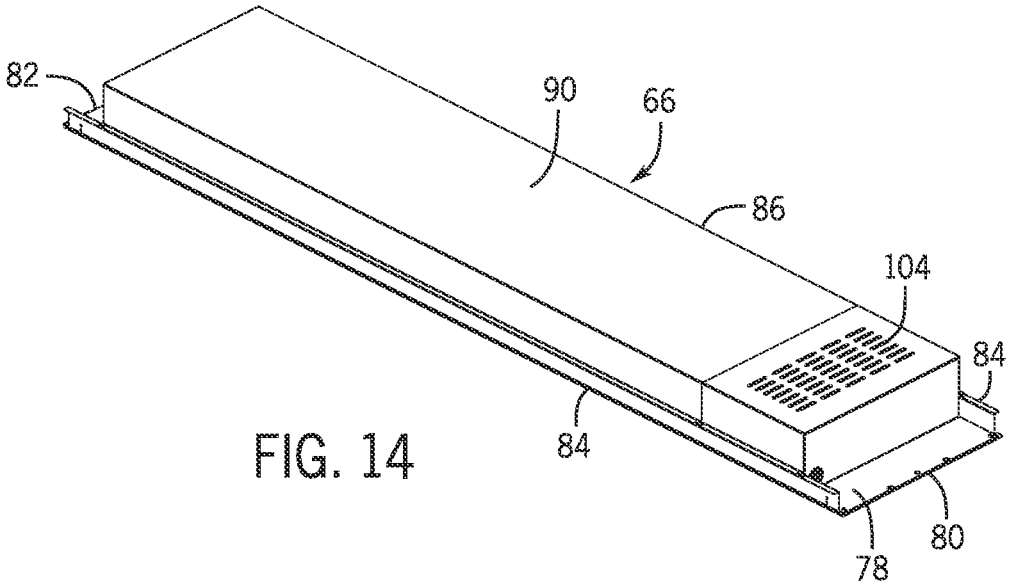
FIG. 14 is a top isometric view of one of the air exhaust panels.
Figure 15:
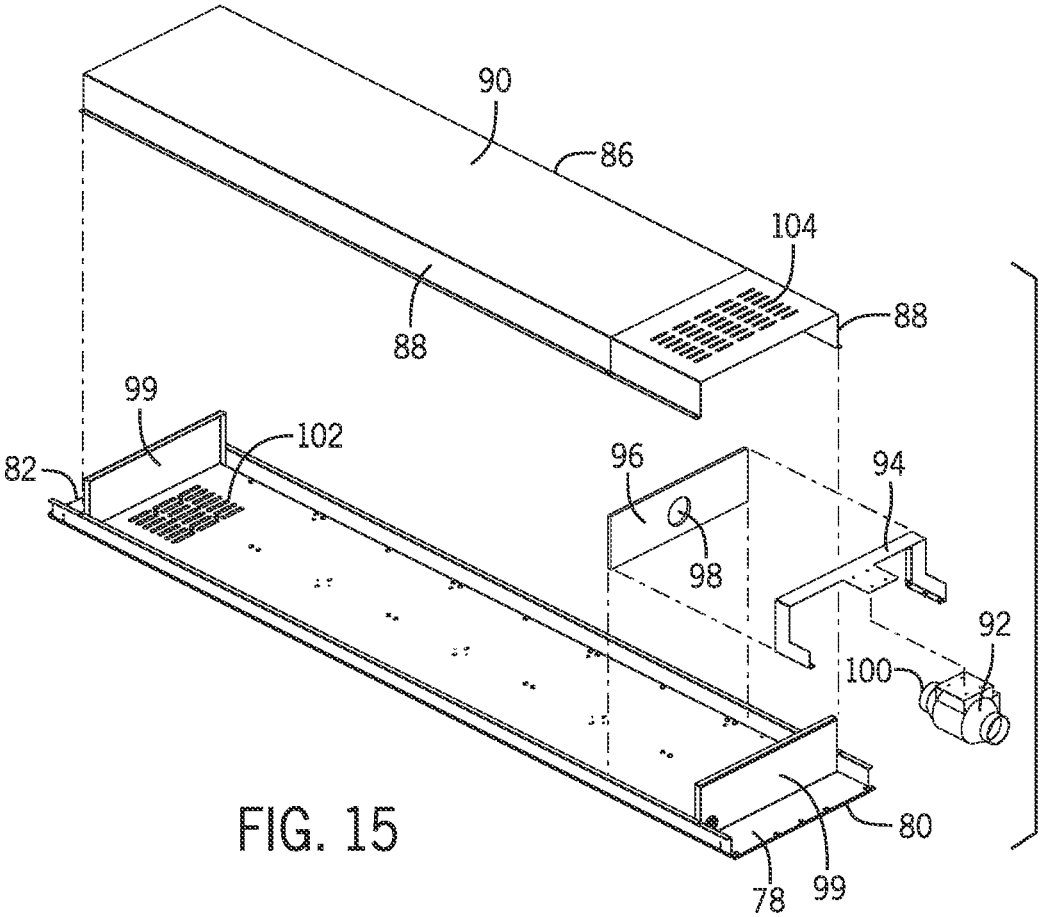
FIG. 15 is an exploded view of the air exhaust panel shown in FIG. 14.

FIGS. 9 and 14-15 illustrate the configuration of the air exhaust panel 66 constructed in accordance with the present disclosure. The air exhaust panel 66 includes a bottom tray 78 that extends between a first end 80 and a second end 82. The bottom tray 78 is formed from a metal material, such as steel, and includes upstanding side walls 84. The bottom tray 78 is designed to support an air flow enclosure 86 that has open ends. The air flow enclosure 86 is formed from steel and includes a pair of spaced side walls 88 and a top wall 90. When assembled, the combination of the bottom tray 78 and the air flow enclosure 86 creates an open air plenum that allows air to flow from the second end 82 toward the first end 80 upon the activation of an exhaust fan 92.

The exhaust fan 92 is mounted to operate within the enclosed air plenum by a fan bracket 94. In the embodiment shown, the exhaust fan 92 includes an electric motor that rotates a fan blade. The air exhaust panel 66 includes an electrical subassembly (not shown) that allows electric power within the office space to power the exhaust fan. A plate 96 having an air opening 98 allows air to be drawn into the air inlet of the exhaust fan 92. A pair of end walls 99 define the ends of the air plenum such that the air plenum is generally closed by the combination of the air flow enclosure 86 and the end walls 99. When the exhaust fan 92 operates, air is drawn into the air plenum through a first vent opening 102 that is formed in the bottom tray 78. The first vent opening 102 is open to the interior of the enclosed office, as illustrated in FIG. 8. When the electric exhaust fan 92 operates, air is drawn from the interior of the office through the first vent opening 102 and travels along the enclosed air plenum and is exhausted from the air flow enclosure 86 through the second vent opening 104. Thus, when the exhaust fan 92 operates, air is pulled from within the enclosed office and is discharged through the second vent opening 104.

Figure 10:
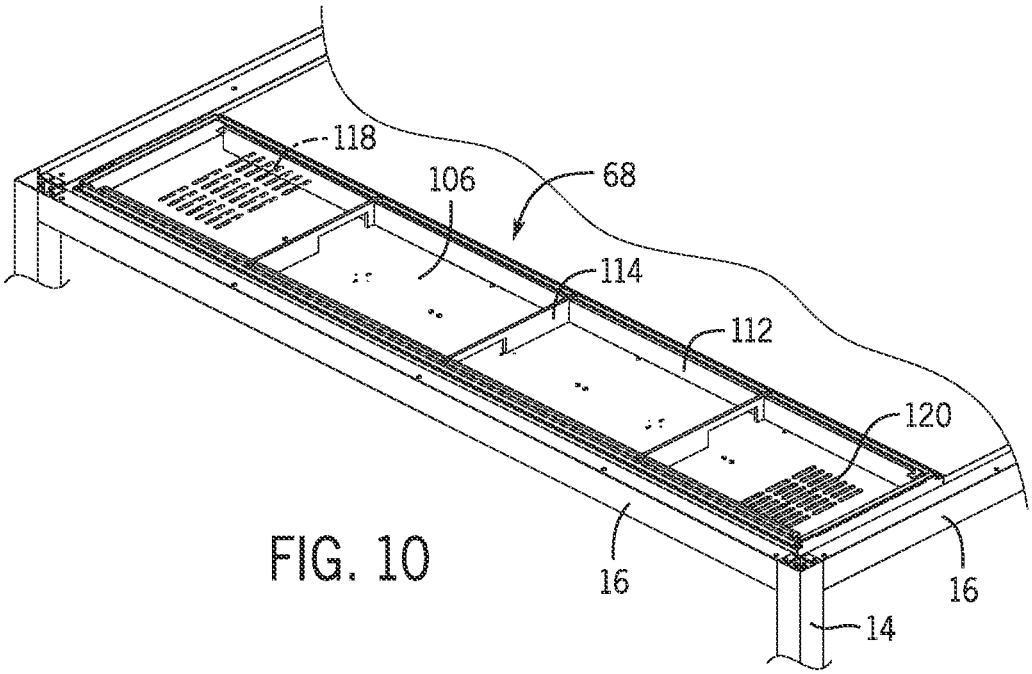
FIG. 10 is a partial section view of an air intake panel that forms part of the completed ceiling shown in FIG. 7.
Figure 16:
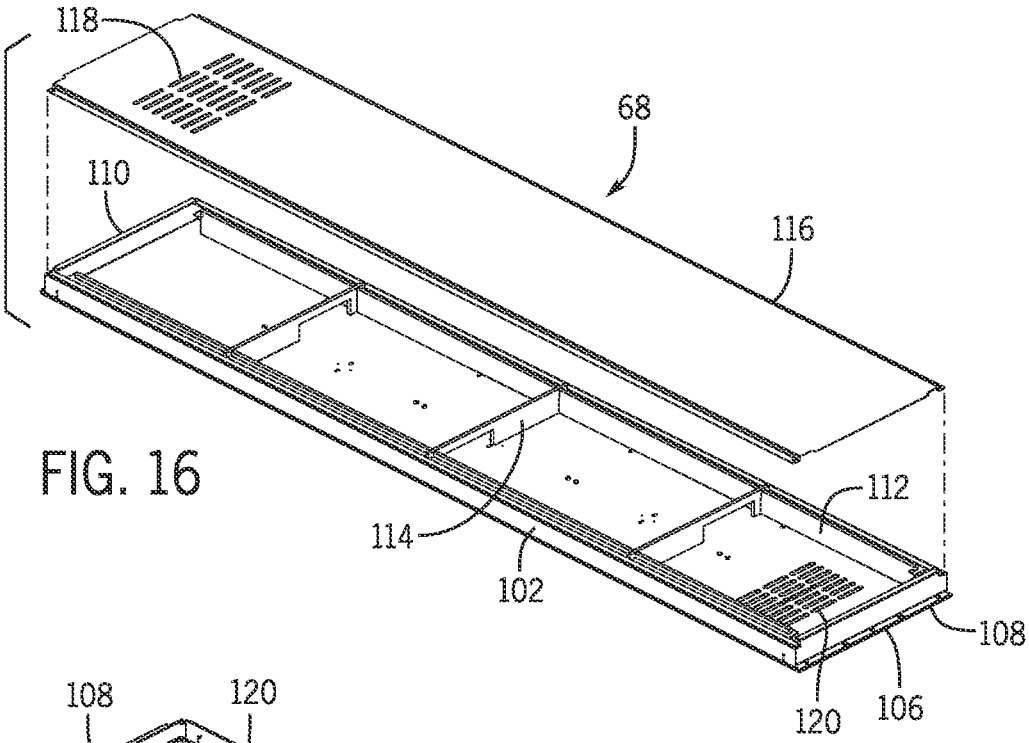
FIG. 16 is an exploded view of the air intake panel.
Figure 17:
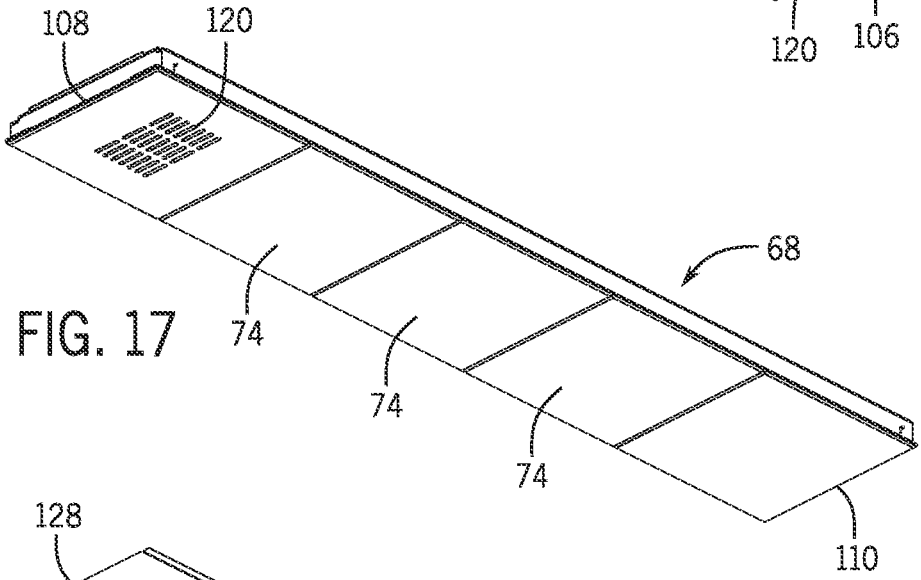
FIG. 17 is a bottom isometric view of the air intake panel.

FIGS. 10 and 16-17 illustrate the configuration of the air inlet panel 68. The air inlet panel 68, like the air exhaust panel, includes a bottom tray 106 that is formed from a metallic material, such as steel. The bottom tray 106 extends from a first end 108 to a second end 110. The air inlet panel 68 includes a pair of side walls 112 and a series of PET baffles 114 that extend between the side walls 112. A top panel 116 is supported by the pair of side walls 112. A seal assembly creates an airtight seal between the top panel 116 and the side walls 112 to create an enclosed, internal air plenum.

The top panel 116 includes a first vent opening 118 that is open to the open space within the building containing the office structure. A second vent opening 120 is designed to face into the open interior of the enclosed office space. When the exhaust fan 92 shown in FIG. 15 is operated to withdraw air from within the interior of the office space, the exhausted air creates a reduced pressure within the office space. The reduced pressure within the office space draws air into the office space from outside of the office space through the first vent opening 118 in the air intake panel 68. The air flows through the air intake panel and exits at the second vent opening 120 where the air flows into the open interior of the office space. In this manner, a combination of the air exhaust panel 66 and the air inlet panel 68 allows for the circulation of fresh air into the enclosed office space.

In one contemplated embodiment of the present disclosure, the top panel 116 can be magnetically connected to the side walls 112 and will create an airtight seal between the top panel 116 and the side walls 112. The magnetic connection between the top panel 116 and the side walls 112 will allow for easy access to the open air plenum and will help to create the airtight seal. A flexible seal arrangement can be used to create the airtight seal while the magnetic connections would be used to compress the airtight seal to create the sealed enclosure, which is required to allow the low pressure within the open interior of the office space to draw air into the office space through the first vent opening 118. As shown in FIG. 17, the bottom surface of the air inlet panel 68 includes a series of sound absorbing tiles 74.

Figure 18:
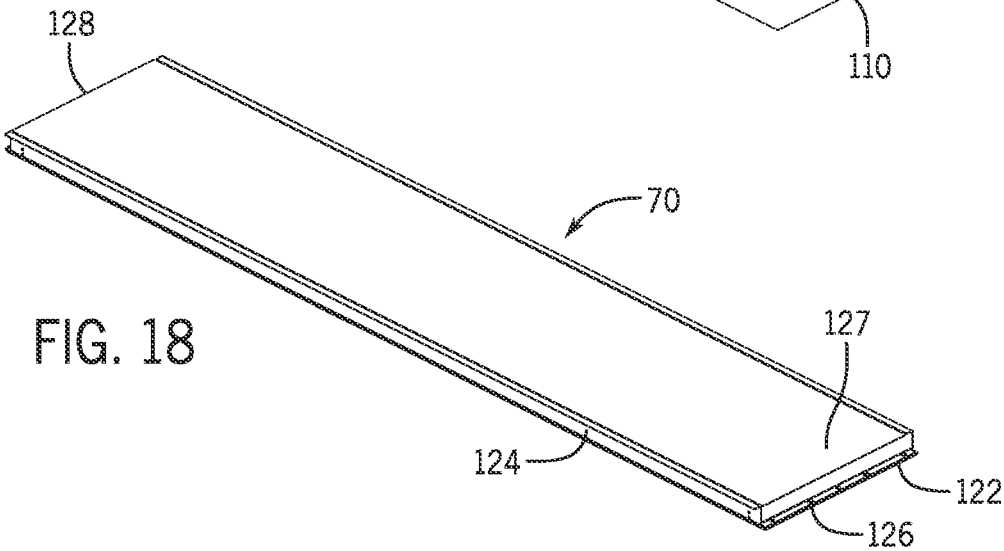
FIG. 18 is a top isometric view of one of the ceiling panels.
Figure 19:
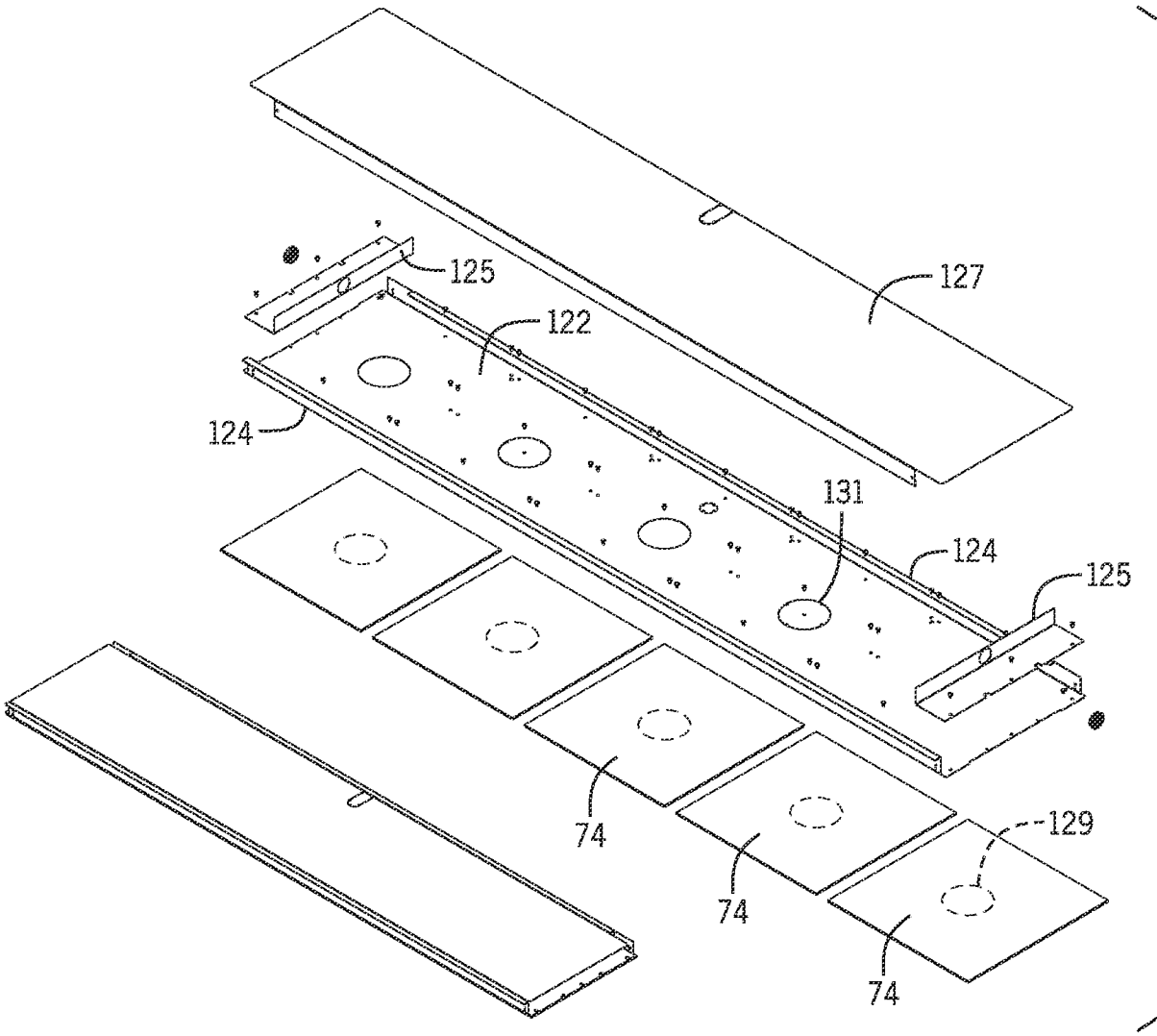
FIG. 19 is an exploded view of the ceiling panel.

FIGS. 18 and 19 illustrates one of the ceiling panels 70. The ceiling panel 70 includes a similar bottom tray 122 that includes the side walls 124. As can be understood in the Figures, the bottom tray 122 has a length from the first end 126 to the second end 128 that is the same as the air exhaust panel 66 and the air inlet panel 68 such that the air exhaust panel 66, the air inlet panel 68 and the ceiling panels 70 can be positioned in various locations along the header bracket 72 to allow the ceiling to be configured as desired. The ceiling panel 70 includes a cover member 127 that combines with a pair of end walls 125 to create an open interior of the ceiling panel.

A series of acoustic tiles 74 are each mounted to the bottom surface of the bottom tray by a series of screws. Each of the acoustic tiles includes a center cutout 129 that is formed from a score line in the top surface of the tile such that the cutout 129 is not visible from below the acoustic tile 74 when the tile is attached to the back surface of the bottom tray 122. The cutout 129 generally aligns with a corresponding cutout 131 that formed in the bottom tray 122 and defined by a score line. The cutout 131 can be removed in any desired location that will receive a light.

Figure 11:
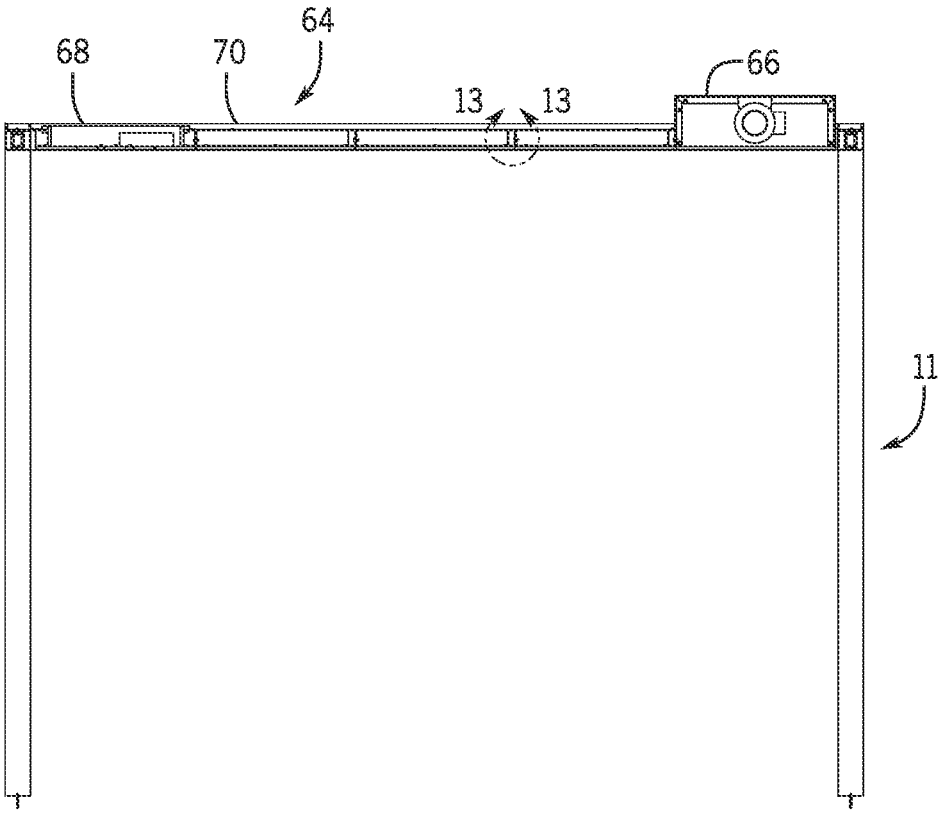
FIG. 11 is a side view of the exemplary embodiment of the completed ceiling shown in FIG. 7.
Figure 12:
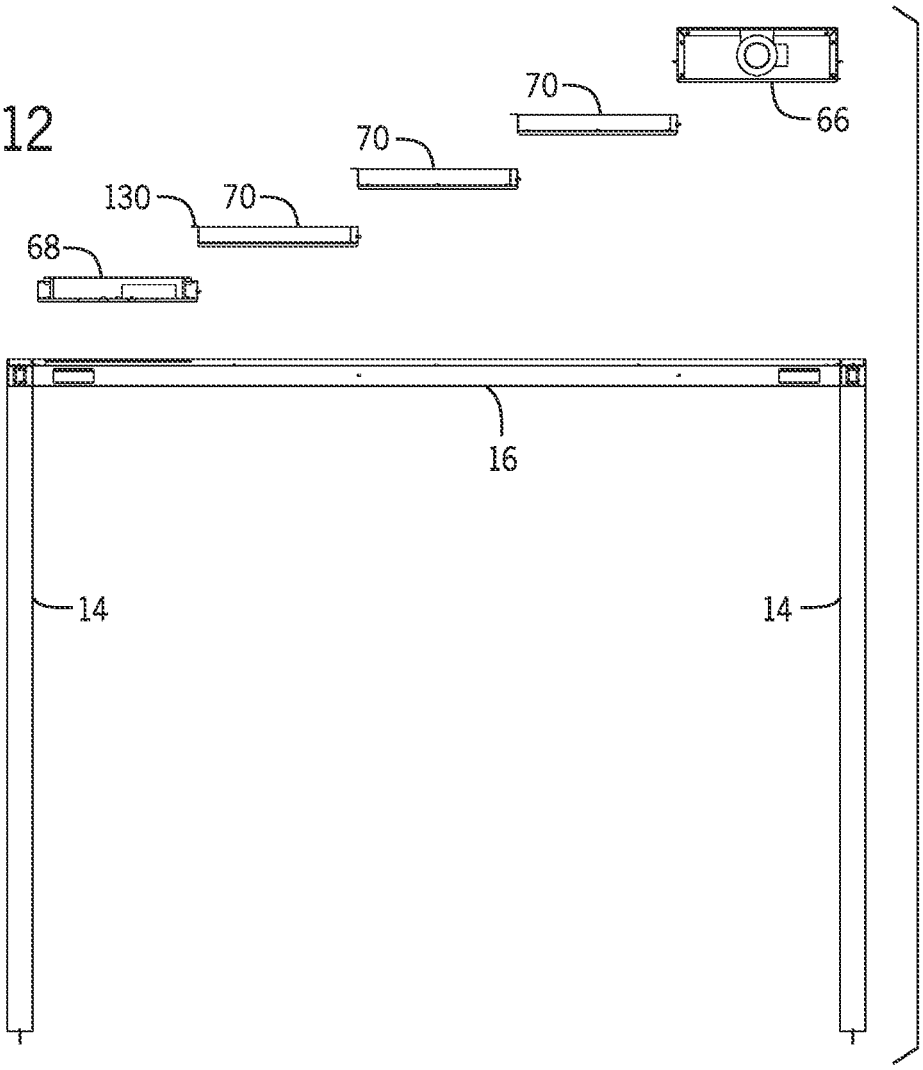
FIG. 12 is a magnified, exploded side view showing the interconnection between the ceiling panels, the air exhaust panel, the air intake panel and the frame structure.
Figure 13:
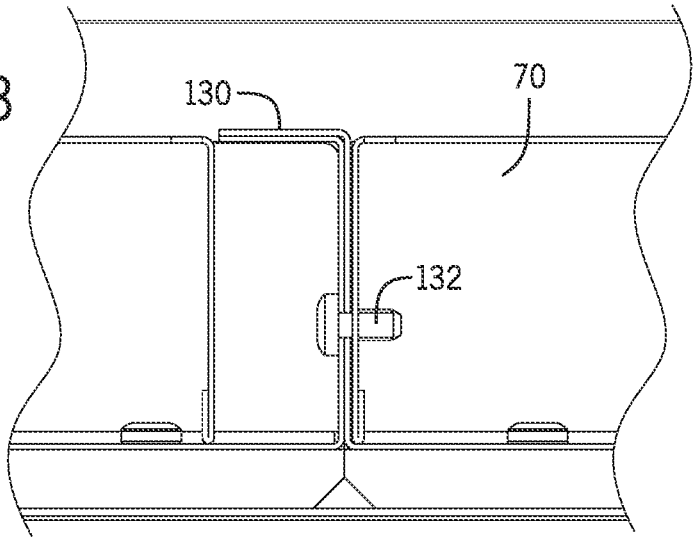
FIG. 13 is a magnified, section view taken along line 13-13 in FIG. 11.

FIG. 11 is a side view of the ceiling 64 shown in FIG. 7 as supported by the support frame 11. As indicated above, the ceiling 64 in the first exemplary embodiment includes the air exhaust panel 66, the air inlet panel 68 and three ceiling panels 70. As illustrated in the exploded view of FIG. 12, each of the panels that form the ceiling 64 has generally the same width such that the length of the head beam 16 between a pair of the vertical columns 14 can be selected to be a multiple of the width of the panels. In this manner, the office space can be configured having different lengths and widths depending upon the user requirement. As can be seen in FIG. 12, each of the ceiling panels 70 includes an extending attachment flange 130. FIG. 13 illustrates the attachment flange 130 of the ceiling panel 70 being positioned on top of either an adjacent ceiling panel 70 or one of the air inlet panel 68 or the air exhaust panel 66. A connector 132 can be used to securely join the adjacent panels to define the overall ceiling structure.

Figure 20:
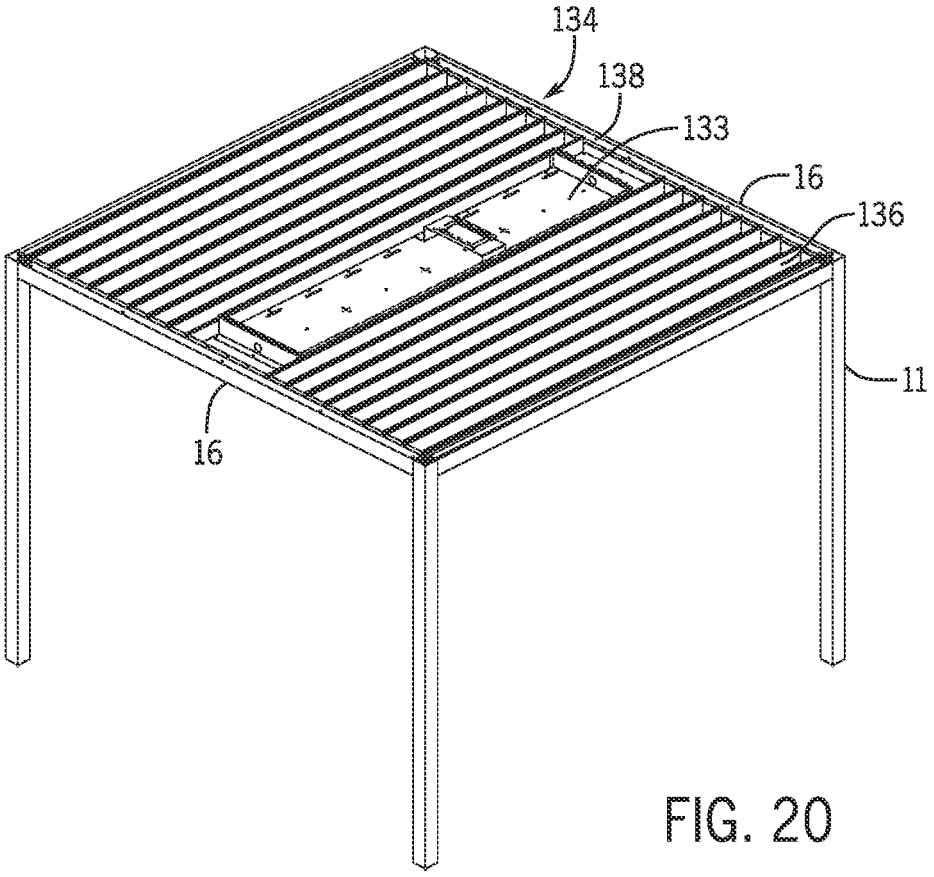
FIG. 20 is a top isometric view showing a second exemplary embodiment of a completed ceiling supported by the frame structure.
Figure 21:
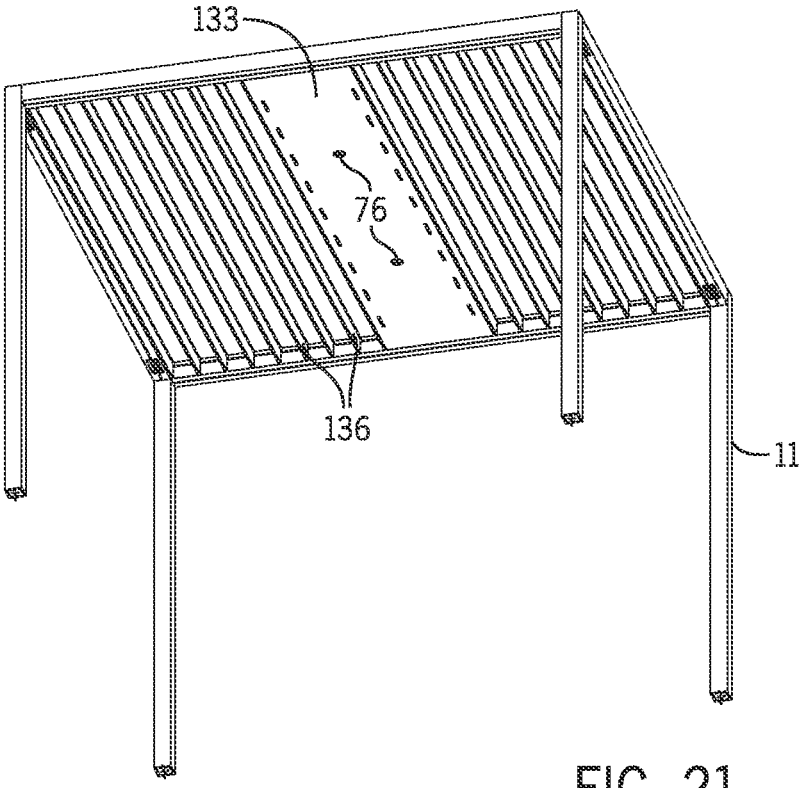
FIG. 21 is a bottom isometric view of the second exemplary embodiment of the completed ceiling shown in FIG. 19.

FIGS. 20 and 21 illustrate another exemplary embodiment of an office structure constructed utilizing the support frame 11 of the present disclosure. In the embodiment shown in FIGS. 20 and 21, a single air vent panel 133 is used and is supported between a pair of the head beams 16. The air vent panel 133 is yet another type of panel that can be used to form the ceiling 64. In the embodiment shown, the air vent panel 133 includes a pair of lights 76 that project light from an undersurface of the air vent panel 133. Unlike the previous embodiment, the remainder of the ceiling 134 is defined by a series of spaced louvers 136 that each also extend between the pair of spaced head beams 16. In the embodiment illustrated, a support bracket 138 mounted to the head beams 16 provide the required support for each of the louvers 136. Although an air vent panel 133 is shown in the embodiment of FIGS. 20 and 21, the air vent panel 133 could be replaced by additional louvers, an air inlet panel or an air exhaust panel depending upon the user requirements.

Figure 22:
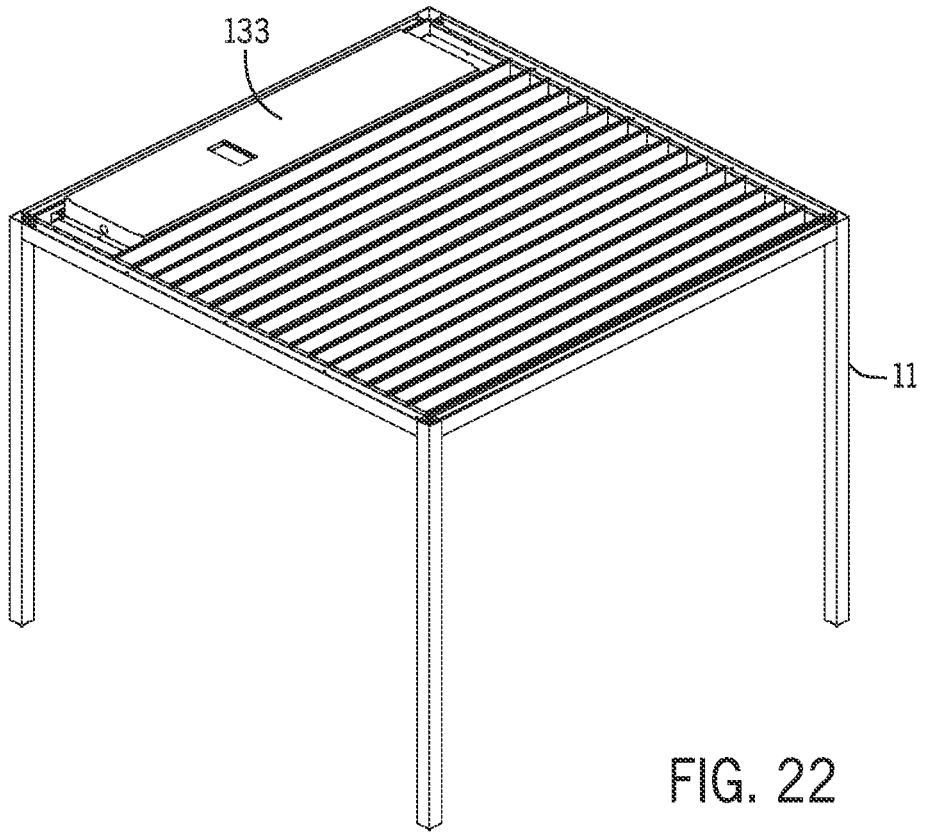
FIG. 22 is a top isometric view showing a third exemplary embodiment of a completed ceiling supported by the frame structure.
Figure 23:
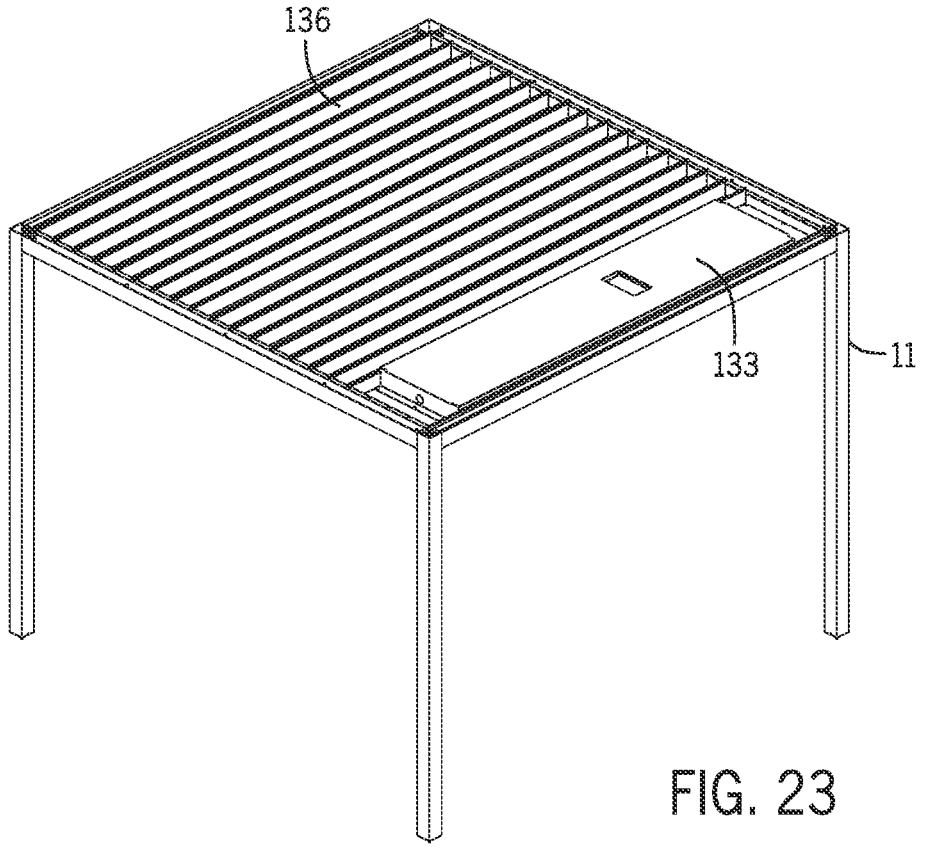
FIG. 23 is a bottom isometric view of the third exemplary embodiment of the completed ceiling shown in FIG. 21.

FIGS. 22 and 23 illustrate yet another exemplary embodiment of an office space constructed utilizing the support frame 11. In this embodiment, the air vent panel 133 is moved either to a first end (FIG. 21) or a second end (FIG. 22) and is used in combination with the spaced louvers 136. The embodiments shown in FIGS. 20-23 illustrate only a few of the various different possible configurations of an office space constructed utilizing the office structure of the present disclosure.

Figure 24:
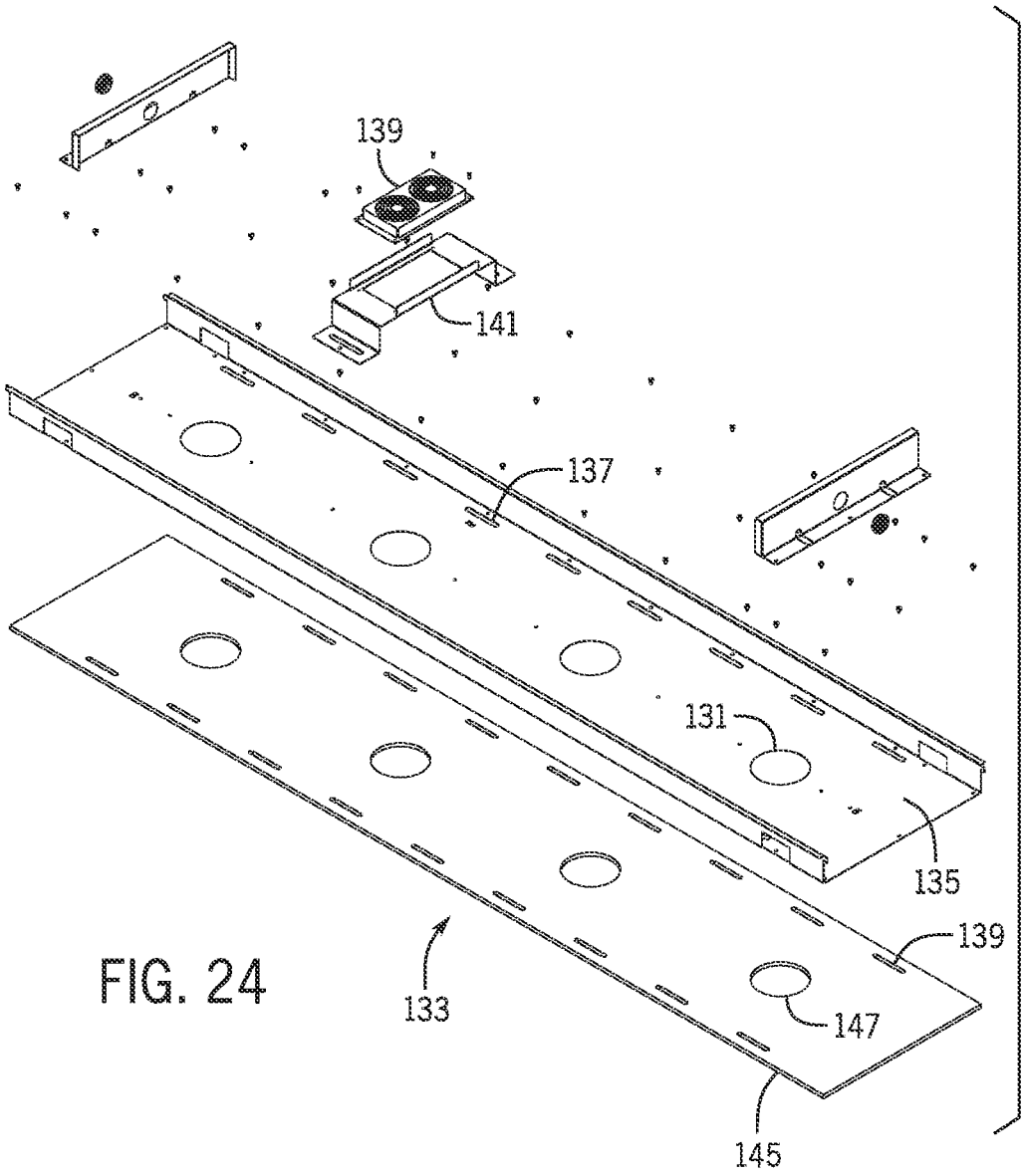
FIG. 24 is an exploded view of the air vent panel.

FIG. 24 is a detailed view of the air vent panel 133. The air vent panel 133 is designed to be used with a ceiling having louvers and is designed to circulate air within the office space. The air vent panel 133 includes a bottom tray 135 that includes similar cutouts 131 designed to receive a light assembly. In addition, the bottom tray includes a series of vent openings 137 that allow air to exit the interior of the air vent panel. The air vent panel 133 includes a pair of electric fans 139 that each operate to create an airflow. The fans 139 are mounted to a support bracket 141 and are connected to a supply of electricity. The air vent panel 133 further includes a tile plate 145 that includes the cutouts 147 and vent openings 149 that align with the cutouts 131 and vent openings 137 in the bottom tray 135. The air vent panel 133 operates to circulate air within an enclosed office space in an embodiment where air can flow freely into an out of the office space as compared to the use of the separate air exhaust panel 66 and the air inlet panel 68 in the embodiment of FIG. 7.

Figure 25:
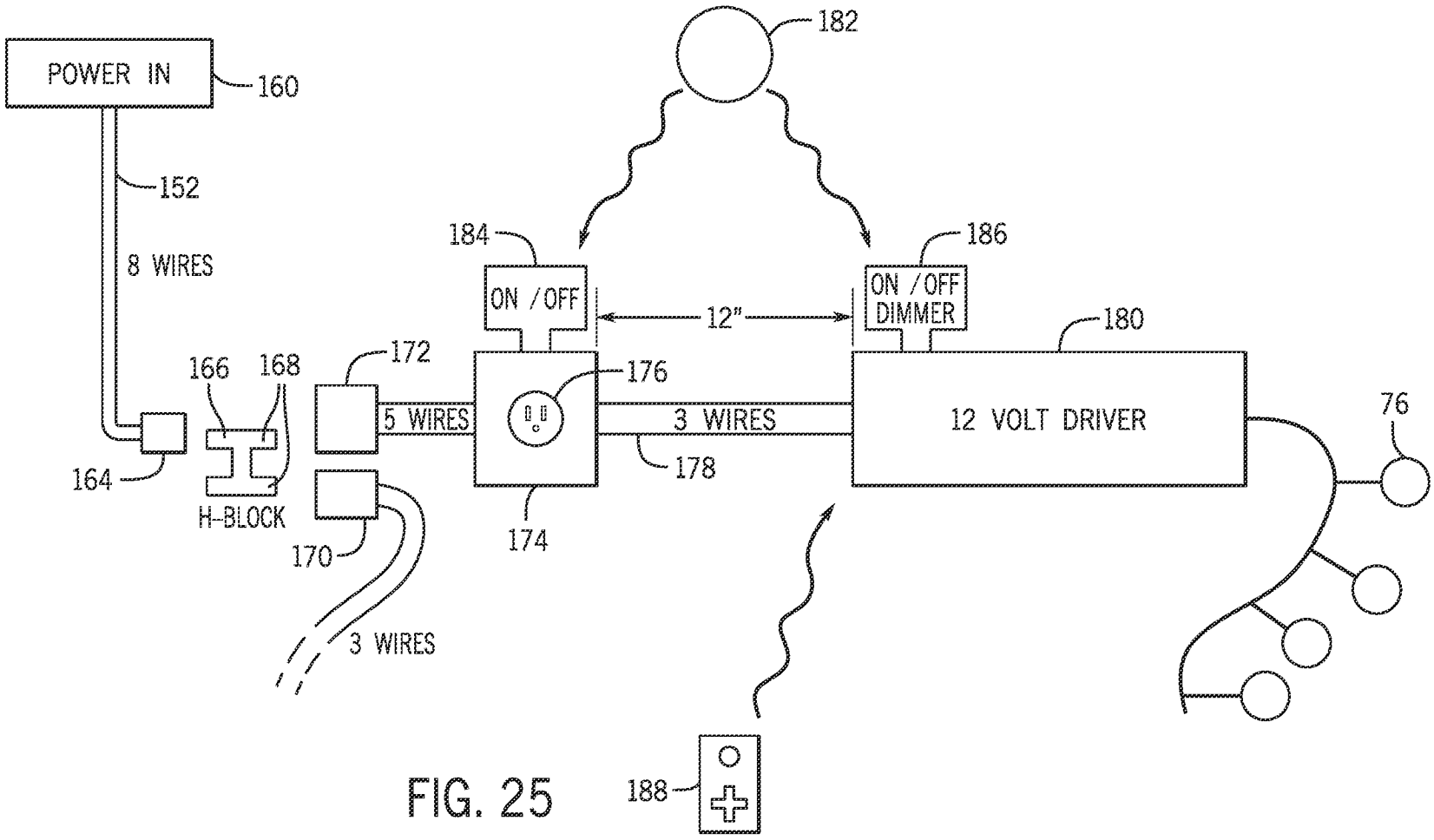
FIG. 25 is an electrical schematic showing the power connections and controls for the ceiling including lights and a fan.

FIG. 25 is an electrical schematic showing the electrical connections required for powering the exhaust fan and the light assemblies contained in the ceiling panels. As shown in FIG. 25, a utility power supply 160 is received in one of the ceiling panels. The utility power supply 160 includes an eight wire bundle 162 that includes a plug 164. The plug 164 is received by an H-block connector 166. The H-block connector includes two outlet sockets 168 that allow for a pair of connections. The first connection is to a plug 170 that connects the ground wires to a ground location on the panels. The second connection is to a second plug 172 that connects five of the wires to a junction box 174 having an outlet 176. The outlet 176 is a typical outlet that can receive a plug from the exhaust fan included in the air exhaust panel.

Three wires in the wire bundle 178 connect to a 12-Volt driver 180 that is used to power a series of the light assemblies 76. The light assemblies are 12-Volt LED light assemblies that are driven by the driver 180.

In the embodiment shown in FIG. 25, a ceiling sensor 182 is mounted in one of the ceiling panels. The ceiling sensor 182 is designed to generate an occupancy signal when the ceiling sensor 182 detects the presence of a person in the enclosed office space. When the presence of a person is detected, a wireless signal is sent to a wireless receiver 184 associated with the junction box 174. The wireless receiver 184 includes an on/off switch that controls the supply of power to the exhaust or ventilation fan such that the fan operates only when an person is present in the enclosed office space. The wireless presence signal can also be received by a second wireless receiver 186 associated with the 12-Volt driver 180 to turn on/off the light assemblies associated with the driver 180.

In addition to the ceiling sensor 182, the electrical system shown in FIG. 25 can includes a remote switch 188 that can generate a wireless command signal upon activation by a person in the office space. The remote switch 188 can be configured to generate a simple on/off signal or can be configured to generate a signal that dims the light assemblies controlled by the driver 180. The remote switch 188 can be located anywhere in the enclosed office space and in communication range of the wireless receiver 186.

Figure 26:
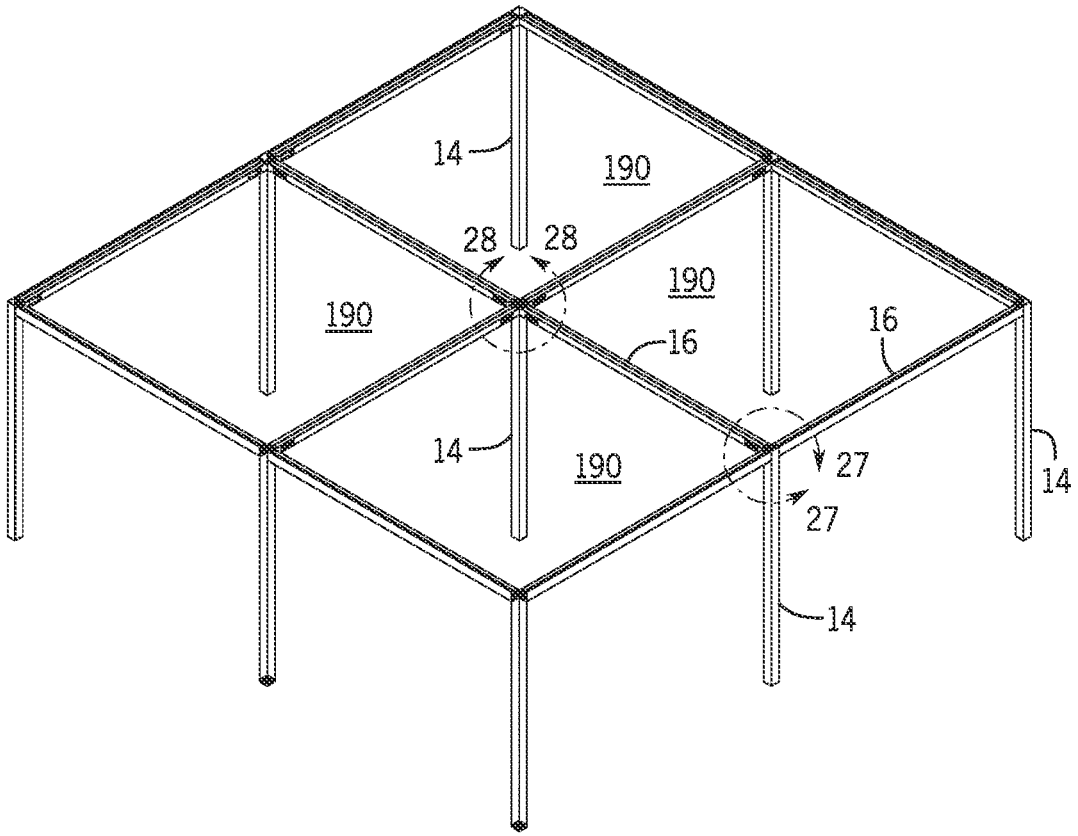
FIG. 26 is an overhead view showing the interconnection between multiple office spaces.

FIG. 26 illustrates the uses of a plurality of support frames 11 connected together to create the framework for a bank of office spaces 190. In the embodiment shown in FIG. 26, four modular spaces are shown connected to each other. As can be understood in the illustration of FIG. 26, several of the vertical columns 14 and several of the horizonal head beams 16 can be used to form the framework for more than one office space 190. If the framework shown in FIG. 26 is used to form four office spaces 190, a wall panel will extend between each of the internal vertical columns 16. However, the framework shown in FIG. 26 could be configured as only two offices or as a single office depending upon the location of the wall panels. The framework shown in FIG. 26 could be configured to define the desired number of office spaces at the initial set up or could be modified after the initial set up by removing previously installed wall panels.

Figure 27:
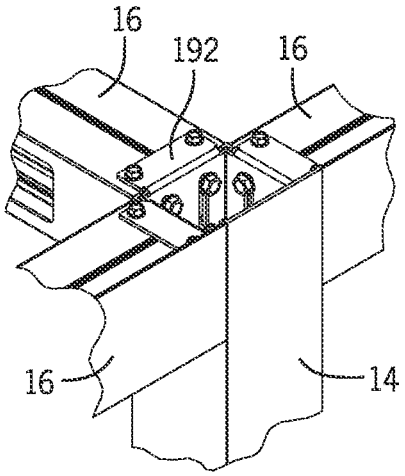
FIG. 27 is a magnified view showing the connection between three head beams and a vertical column.

FIG. 27 illustrates the configuration of the vertical column 14 that is located in the center of one of the sides and is connected to three of the head beams 16. In this embodiment, the lock bracket 192 is configured to have three top flanges 194 that each connect to one of the head beams 16 in a similar manner as described in FIG. 3.

Figure 28:
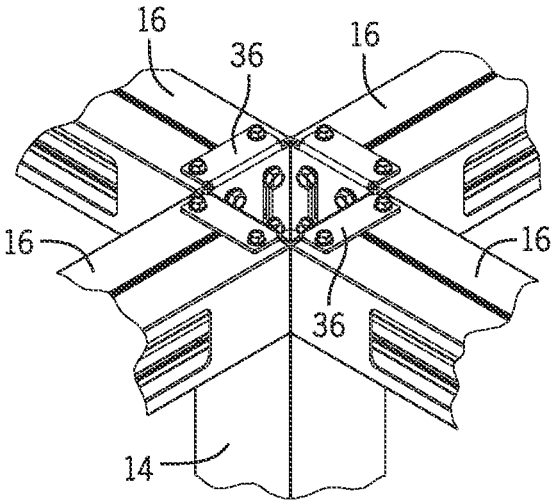
FIG. 28 is a magnified view showing the connection between four head beams and a vertical column.

FIG. 28 illustrates the configuration of the vertical column 14 that is located at the center of the framework shown in FIG. 26. In this embodiment, two separate lock brackets 36 are used to create the connection between the four head beams 16 and the single vertical column 14. The combination of the pair of lock brackets 36 creates a stable connection between the vertical column 14 and the four head beams 16 as illustrated.

Figure 29:
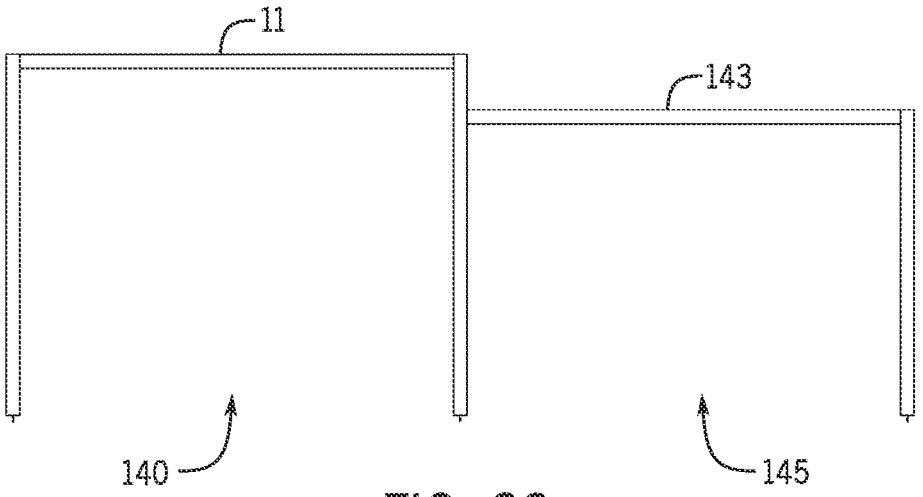
FIG. 29 is a side view showing two frame structures joined to each other to define office spaces having different heights.
Figure 30:
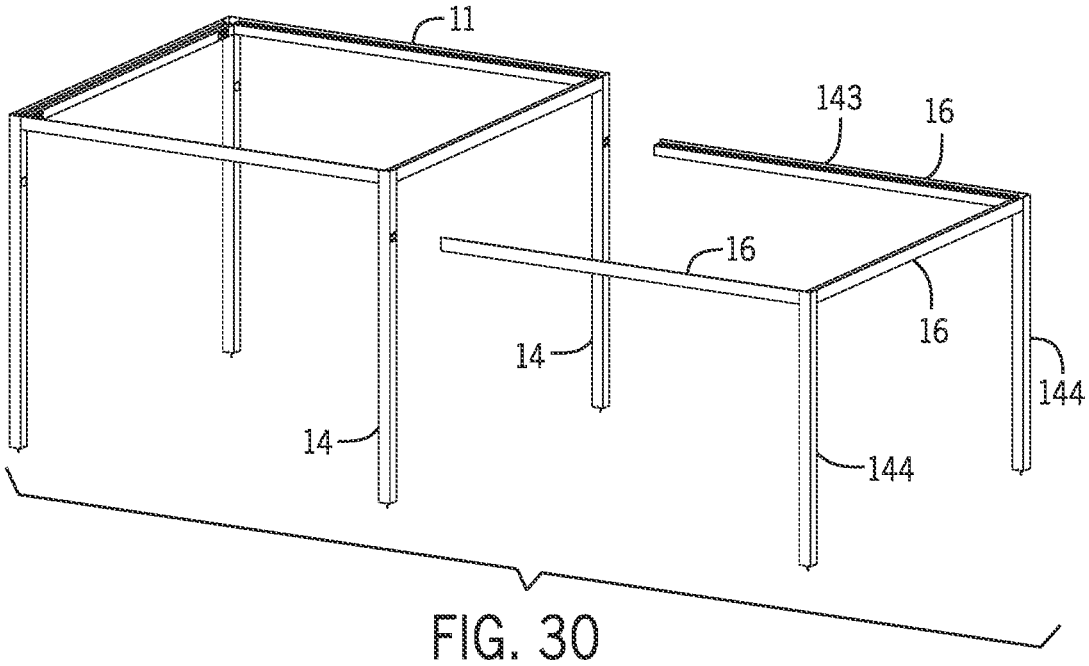
FIG. 30 is an exploded, isometric view of the two frame structures.

In the embodiment of FIG. 26, each of the office spaces has the same height ceiling since the head beams are connected to vertical columns having the same height. However, FIGS. 29 and 30 illustrate the construction of two separate office spaces 140 and 145 that have different height ceiling by utilizing a first frame structure 11 and a second frame structure 143. The first frame structure 11 is identical to the frame structures previously described. However, in the embodiment shown in FIGS. 29 and 30, the second frame structure 143 includes only a single pair of reduced height vertical columns 144 and three head beams 16. A pair of the head beams 16 provide the connection between the second frame structure 143 and the first frame structure 11. The head beams of the second frame structure 143 are securely attached to the vertical columns 14 of the first support frame 11 at a location below the top end of the vertical column 14. In this manner, the second frame structure 143 can be formed having a different height and can be attached to the first frame structure 11.

Figure 31:
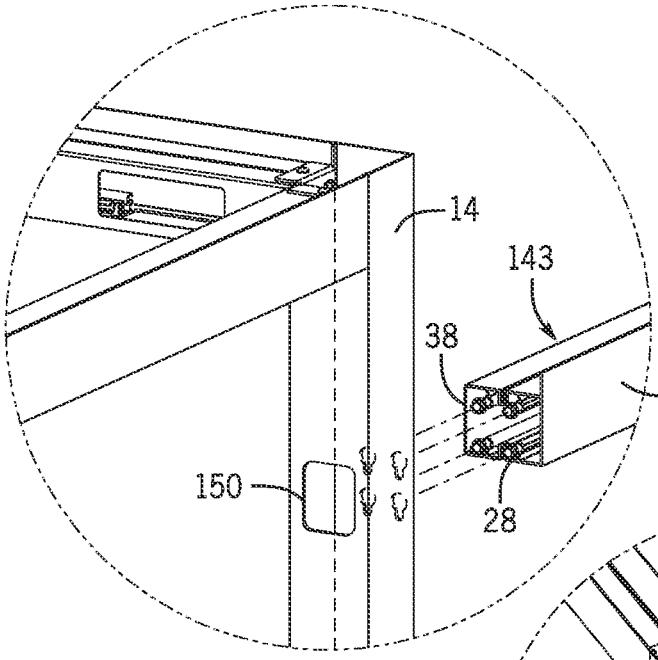
FIG. 31 is an isometric view showing the connection between the two frame structures.
Figure 32:
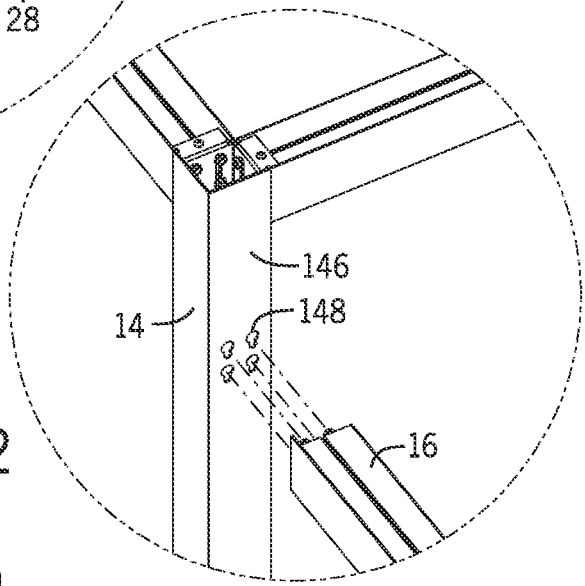
FIG. 32 is an isometric view showing the connection between the two frame structures.
Figure 33:
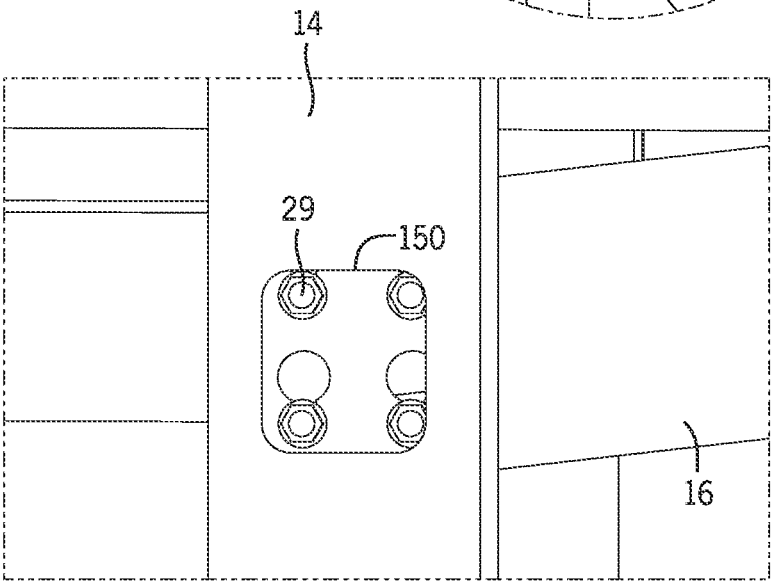
FIG. 33 is a magnified view of the connection shown in FIG. 32.

Referring now to FIGS. 31-33, the point of connection between the head beam 16 of the second frame structure 143 and the vertical column 14 of the first frame structure 11 is shown and described. As shown in FIG. 32, face 146 formed on the vertical column 14 includes a plurality of keyways 148. The keyways 148 each include an expanded upper portion and a lower key slot. The keyways 148 are spaced and oriented in a manner to correspond to the position of the connecting bolts 28 extending from the end 38 of the head beam 16. In this manner, the head portion of each connecting bolt 28 is aligned with the expanded diameter opening of the keyway 148 and the expanded head pass through the keyway 148. The head beam 16 can thus be lowered into the reduced size portion of the keyway 148. Once in this position, as shown in FIG. 33, the user can tighten each of the heads 29 to secure the head beams 16 to the vertical column 14. As shown in FIGS. 31 and 33, an access opening 150 can be formed in the opposite wall of the vertical column 14 to allow the user to access the heads 29 to tighten the heads and connect the head beam 16 to the vertical column 14. Once the second frame structure 143 is assembled and connected to the first frame structure, separate ceilings and wall panels can be positioned on both of the frame structures. In this manner, two enclosed office structures can be formed that are joined to each other and include common components.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A system for creating an enclosed room in an open space having a floor and a ceiling, comprising:

a frame structure having a plurality of vertical columns that each have a first end supported on the floor and a second end spaced below the ceiling of the open space, the frame structure including a plurality of head beams connected between the second ends of the vertical columns;

a plurality of anchor brackets mounted to the floor of the open space, each of the anchor brackets being configured to receive the first end of one of the plurality of vertical columns;

a plurality of ceiling panels each extending between and supported by two of the plurality of head beams, wherein the plurality of ceiling panels interlock with each other; and an air exhaust panel extending between and supported by two of the plurality of head beams and including an exhaust fan operable to withdraw air from the enclosed room and exhaust the withdrawn air into the open space, the air exhaust panel including a first vent open to an interior of the enclosed room and a second vent open to the open space, wherein the first vent and the second vent are spaced from each other along a length of the air exhaust panel and are each in fluid communication with each other through an enclosed plenum extending between the first vent and the second vent, wherein the plurality of ceiling panels and the air exhaust panel combine to define a ceiling of the enclosed room that is located below the ceiling of the open space.

2. The system of claim 1 wherein the air exhaust panel includes a removable top wall that creates a seal with sidewalls of a bottom tray to create the enclosed plenum.

3. The system of claim 1 wherein at least one of the ceiling panels is an air intake panel having a first vent open to an interior of the enclosed room and a second vent open to the open space with an enclosed plenum extending between the first vent and the second vent.

4. The system of claim 3 wherein the air intake panel includes a removable top panel that creates a seal with sidewalls of a bottom tray to create the enclosed plenum.

5. A system for creating an enclosed room in an open space having a floor and a ceiling, comprising:

a frame structure having a plurality of vertical columns that each have a first end supported on the floor and a second end spaced below the ceiling of the open space, the frame structure including a plurality of head beams connected between the second ends of the vertical columns, wherein each of the vertical columns includes at least one attachment slot extending into a body of the vertical column from the second end, wherein one or more connectors are received in an end of the one of the head beams, the connectors being movable within the at least one attachment slot such that the head beams and the vertical columns are movable relative to each other;

a plurality of anchor brackets mounted to the floor of the open space, each of the anchor brackets being configured to receive the first end of one of the plurality of vertical columns;

a plurality of ceiling panels each extending between and supported by two of the plurality of head beams to define a ceiling of the enclosed room that is located below the ceiling of the open space, wherein the plurality of ceiling panels interlock with each other; and a lock bracket having a receiving slot to receive the one or more connectors received in the end of the one of the head beams, the lock bracket being attached to the one of the head beams to close the end of the head beam.

6. The system of claim 5 wherein the head beams are formed from extruded aluminum and includes a plurality of receiving channels each sized to receive one of the connectors.

7. The system of claim 1 further comprising a plurality of wall panels each mounted between two of the vertical columns such that the wall panels are each supported by the frame structure.

8. A system for creating an enclosed room in an open space having a floor and a ceiling, comprising:

a frame structure having a plurality of vertical columns that each have a first end supported on the floor and a second end spaced below the ceiling of the open space, the frame structure including a plurality of head beams connected between the second ends of the vertical columns;

a plurality of wall panels each mounted between two of the vertical columns such that the wall panels are supported by the frame structure and enclose open space between the vertical columns;

a plurality of ceiling panels each extending between and supported by two of the plurality of head beams;

at least one air exhaust panel extending between and supported by the two of the plurality of head beams, the at least one air exhaust panel including an exhaust fan operable to withdraw air from the enclosed room and exhaust the withdrawn air into the open space, the air exhaust panel including a first vent open to an interior of the enclosed room and a second vent open to the open space, wherein the first vent and the second vent are spaced from each other along a length of the air exhaust panel and are each in fluid communication with each other through an enclosed plenum extending between the first vent and the second vent; and at least one air intake panel extending between and supported by the two of the plurality of head beams, the air intake panel having a first vent open to an interior of the enclosed room and a second vent open to the open space with an enclosed plenum extending between the first vent and the second vent, wherein the plurality of ceiling panels, the at least one air exhaust panel and the at least one air intake panel define a ceiling of the enclosed room that is located below the ceiling of the open space.

9. The system of claim 8, wherein the plurality of ceiling panels, the at least one air exhaust panel and the at least one air intake panel interlock with each other.

10. The system of claim 8 further comprising a plurality of anchor brackets mounted to the floor of the open space, each of the anchor brackets being configured to receive the first end of one of the plurality of vertical columns.

11. The system of claim 8 wherein each of the vertical columns includes at least one attachment slot extending into a body of the vertical column from the second end, wherein one or more connectors are received in an end of one of the head beams, the connectors being movable within the at least one attachment slot such that the head beams and the vertical columns are movable relative to each other.

* * * * *